US011670235B2

(12) United States Patent
Heo et al.

(10) Patent No.: US 11,670,235 B2
(45) Date of Patent: Jun. 6, 2023

(54) PIXEL CIRCUIT AND DISPLAY DEVICE INCLUDING THE SAME

(71) Applicant: LG DISPLAY CO., LTD., Seoul (KR)

(72) Inventors: Seung Ho Heo, Paju-si (KR); Dong Hyun Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/852,771

(22) Filed: Jun. 29, 2022

(65) Prior Publication Data

US 2023/0008071 A1 Jan. 12, 2023

(30) Foreign Application Priority Data

Jul. 8, 2021 (KR) ..... 10-2021-0089989
Nov. 29, 2021 (KR) ..... 10-2021-0167014

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2300/0426* (2013.01); *G09G 2300/0852* (2013.01); *G09G 2310/027* (2013.01)

(58) Field of Classification Search
CPC .. G09G 3/3233; G09G 3/3291; G09G 3/3258; G09G 2320/043; G09G 2320/045; G09G 2320/0295; G09G 2320/0233; G09G 2300/0819; G09G 2300/043; G09G 2330/12
See application file for complete search history.

(56) References Cited

U.S. PATENT DOCUMENTS

2009/0009496 A1 1/2009 Kwak et al.
2011/0164025 A1* 7/2011 Saito ..... G09G 3/3233 345/212
2011/0249044 A1* 10/2011 Ebisuno ..... G09G 3/3233 345/690
2011/0285691 A1* 11/2011 Takasugi ..... G09G 3/3233 345/82
2015/0109278 A1* 4/2015 Kim ..... G09G 3/3233 345/82

FOREIGN PATENT DOCUMENTS

KR 10-2006-0134405 A 12/2006
KR 10-2019-0052822 A 5/2019

OTHER PUBLICATIONS

Combined Search and Examination Report dated Jan. 10, 2023 issued in British Patent Application No. 2209636.6.

* cited by examiner

*Primary Examiner* — Dong Hui Liang
(74) *Attorney, Agent, or Firm* — Morgan, Lewis & Bockius LLP

(57) ABSTRACT

Disclosed are a pixel circuit and a display device including the same. The pixel circuit includes a driving element including a first electrode connected to a first node, a gate electrode connected to a second node, and a second electrode connected to a third node; a first switch element including a first electrode connected to a fourth node, a gate electrode to which a scan pulse is applied, and a second electrode connected to the first node, and configured to be turned on according to a gate-on voltage of the scan pulse while a threshold voltage of the driving element is sensed; and a first capacitor connected between the second node and the fourth node.

18 Claims, 29 Drawing Sheets

PIXEL CIRCUIT AND DISPLAY DEVICE INCLUDING THE SAME

CROSS-REFERENCE TO RELATED APPLICATION

This application claims priority to and the benefit of Korean Patent Application No. 10-2021-0089989, filed Jul. 8, 2021 and, Korean Patent Application No. 10-2021-0167014, filed Nov. 29, 2021, the disclosure of which is incorporated herein by reference in its entirety.

BACKGROUND

1. Technical Field

The present disclosure relates to a pixel circuit and a display device including the same.

2. Discussion of the Related Art

An electroluminescence display device may be divided into an inorganic light emitting display device and an organic light emitting display device according to the material of the emission layer. The active matrix type organic light emitting display device includes an organic light emitting diode (hereinafter, referred to as "OLED") that emits light by itself, and has the advantage of fast response speed, high light-emitting efficiency, high luminance and wide viewing angle. In the organic light emitting display device, the OLED (Organic Light Emitting Diode) is formed in each pixel. The organic light emitting display device has a fast response speed, excellent light-emitting efficiency, luminance, and viewing angle, and has also excellent contrast ratio and color reproducibility because black gray scale can be expressed as complete black.

A pixel circuit of a field emission display device includes an organic light-emitting diode (OLED) used as a light-emitting element and a driving element for driving the OLED. The electrical characteristics of the driving element may change due to the deterioration of the driving element. In this case, since the image quality of an image reproduced on a screen deteriorates, it is necessary to compensate for the electrical characteristics of the driving element. In particular, when the threshold voltage of the driving element has shifted, it is difficult to sense the threshold voltage of the driving element if the shift range exceeds the voltage that can be sensed.

In the case that a driving element is implemented with a transistor including an oxide semiconductor, it is difficult to compensate for the shift of the threshold voltage of the driving element if the threshold voltage of this transistor is 0 [V] or lower. In particular, if the driving element is an n-channel transistor whose threshold voltage is sensed in a diode-connected state and its threshold voltage is shifted to a negative voltage, the threshold voltage of the driving element will not be sensed.

SUMMARY

Accordingly, embodiments of the present disclosure are directed to pixel circuit and a display device including the same that substantially obviate one or more of the problems due to limitations and disadvantages of the related art.

An aspect of the present disclosure is to provide a pixel circuit capable of accurately sensing the threshold voltage of a driving element even when the threshold voltage is shifted, and a display device including the same.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a pixel circuit comprises a driving element comprising a first electrode connected to a first node, a gate electrode connected to a second node, and a second electrode connected to a third node; a first switch element comprising a first electrode connected to a fourth node, a gate electrode to which a scan pulse is applied, and a second electrode connected to the first node, and configured to be turned on according to a gate-on voltage of the scan pulse while a threshold voltage of the driving element is sensed; and a first capacitor connected between the second node and the fourth node.

In another aspect, a display device comprises a display panel on which a plurality of data lines, a plurality of gate lines, a plurality of power lines, and a plurality of subpixels are disposed; a data driver configured to convert pixel data into a data voltage and supply the data voltage to the data lines; and a gate driver configured to supply scan pulses to the gate lines.

A pixel circuit of the subpixels comprises a driving element comprising a first electrode connected to a first node, a gate electrode connected to a second node, and a second electrode connected to a third node; a switch element comprising a first electrode connected to a fourth node, a gate electrode to which the scan pulse is applied, and a second electrode connected to the first node, and configured to be turned on according to a gate-on voltage of the scan pulse while a threshold voltage of the driving element is sensed; and a first capacitor connected between the second node and the fourth node.

The present disclosure can compensate for the threshold voltage of a driving element by sensing the threshold voltage even when the threshold voltage of the driving element is shifted to a negative voltage in an internal compensation circuit of a diode connection type.

The present disclosure can improve the image quality at low gray scale.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
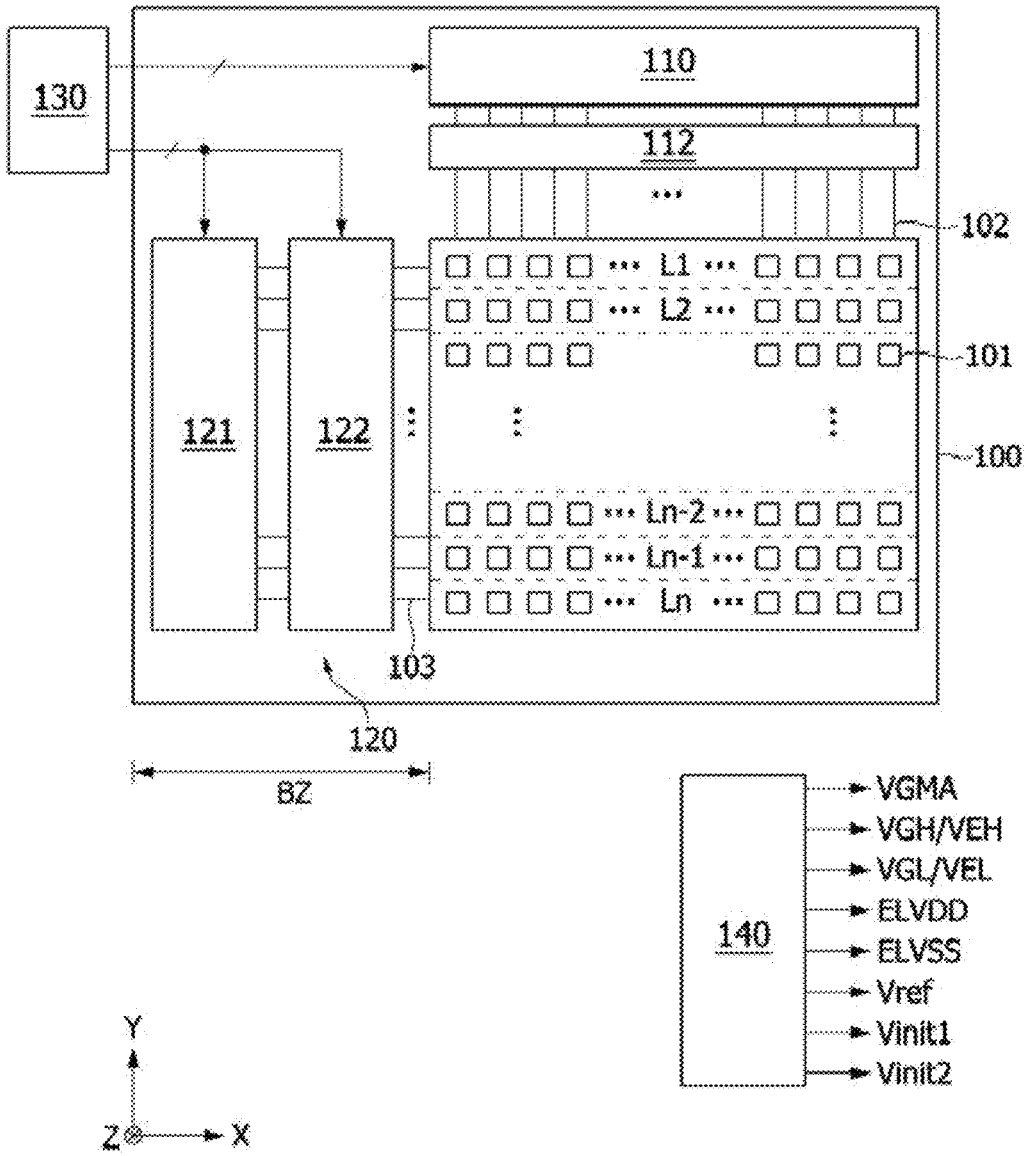
FIG. 1 is a block diagram showing a display device in accordance with one embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure. The present disclosure is only defined within the scope of the accompanying claims.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," and "having," used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The following embodiments can be partially or entirely bonded to or combined with each other and can be linked and operated in technically various ways. The embodiments can be carried out independently of or in association with each other.

Each of the pixels may include a plurality of sub-pixels having different colors to in order to reproduce the color of the image on a screen of the display panel. Each of the sub-pixels includes a transistor used as a switch element or a driving element. Such a transistor may be implemented as a TFT (Thin Film Transistor).

A driving circuit of the display device writes a pixel data of an input image to pixels on the display panel. To this end, the driving circuit of the display device may include a data driving circuit configured to supply data signal to the data lines, a gate driving circuit configured to supply a gate signal to the gate lines, and the like.

In a display device of the present disclosure, the pixel circuit and the gate driving circuit may include a plurality of transistors. Transistors may be implemented as oxide thin film transistors (oxide TFTs) including an oxide semiconductor, low temperature polysilicon (LTPS) TFTs including low temperature polysilicon, or the like. In embodiments, descriptions will be given based on an example in which the transistors of the pixel circuit and the gate driving circuit are implemented as the n-channel oxide TFTs, but the present disclosure is not limited thereto.

Generally, a transistor is a three-electrode element including a gate, a source, and a drain. The source is an electrode that supplies carriers to the transistor. In the transistor, carriers start to flow from the source. The drain is an electrode through which carriers exit from the transistor. In a transistor, carriers flow from a source to a drain. In the case of an n-channel transistor, since carriers are electrons, a source voltage is a voltage lower than a drain voltage such that electrons may flow from a source to a drain. The n-channel transistor has a direction of a current flowing from the drain to the source. In the case of a p-channel transistor, since carriers are holes, a source voltage is higher than a drain voltage such that holes may flow from a source to a drain. In the p-channel transistor, since holes flow from the source to the drain, a current flows from the source to the drain. It should be noted that a source and a drain of a transistor are not fixed. For example, a source and a drain may be changed according to an applied voltage. Therefore, the disclosure is not limited due to a source and a drain of a transistor. In the following description, a source and a drain of a transistor will be referred to as a first electrode and a second electrode.

A gate signal swings between a gate-on voltage and a gate-off voltage. The gate-on voltage is set to a voltage higher than a threshold voltage of a transistor, and the gate-off voltage is set to a voltage lower than the threshold voltage of the transistor.

The transistor is turned on in response to the gate-on voltage and is turned off in response to the gate-off voltage. In the case of an n-channel transistor, a gate-on voltage may be a gate high voltage VGH and VEH, and a gate-off voltage may be a gate low voltage VGL and VEL.

Hereinafter, various embodiments of this disclosure will be described with reference to the accompanying drawings. In the following embodiments, the display device will be described mainly with respect to the organic light emitting display device, but this disclosure is not limited thereto. Also, the scope of this disclosure is not intended to be limited by the names of components or signals in the following embodiments and claims.

Figure 2:
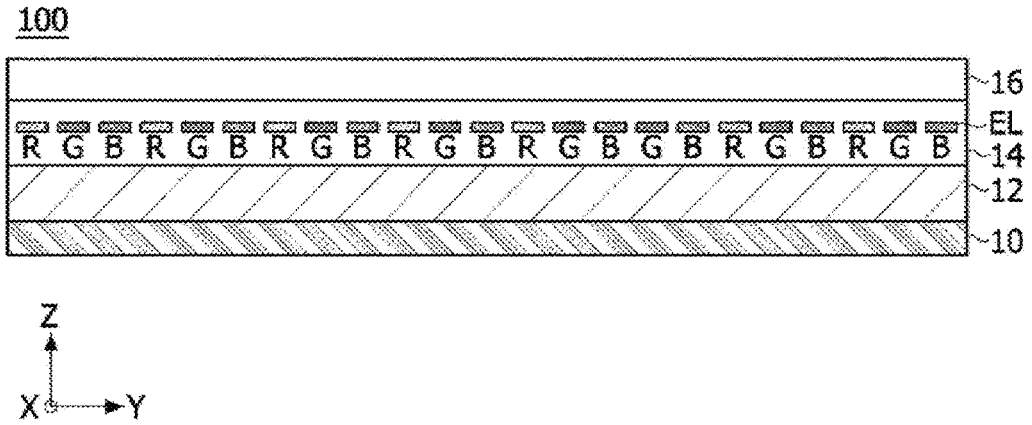
FIG. 2 is a cross-sectional view showing a cross-sectional structure of a display panel in accordance with one embodiment of the present disclosure.

Referring to FIGS. 1 and 2, a display device in accordance with an embodiment of the present disclosure includes a display panel 100, a display panel driver for writing pixel data onto pixels of the display panel 100, and a power supply 140 that generates electric power required to drive the pixels and the display panel driver.

The display panel 100 may be a display panel of a rectangular structure having a length in the X-axis direction, a width in the Y-axis direction, and a thickness in the Z-axis direction. The display panel 100 includes a pixel array that displays an input image on a screen. The pixel array includes a plurality of data lines 102, a plurality of gate lines 103 intersecting the data lines 102, and pixels arranged in a matrix form. The display panel 100 may further include power lines commonly connected to the pixels. The power lines may include a power line to which a pixel driving voltage ELVDD is applied, a power line to which an initialization voltage Vinit is applied, a power line to which a reference voltage Vref is applied, and a power line to which a low-potential power supply voltage ELVSS is applied.

The cross-sectional structure of the display panel 100 may include a circuit layer 12, a light-emitting element layer 14, and an encapsulation layer 16 stacked on a substrate 10, as shown in FIG. 2.

The circuit layer 12 may include a pixel circuit connected to wiring such as a data line, a gate line, and a power line, a gate driver 120 connected to the gate lines, and the like. The wiring and circuit elements of the circuit layer 12 may include a plurality of insulating layers, two or more metal layers separated from each other with the insulating layer therebetween, and an active layer containing a semiconductor material.

The light-emitting element layer 14 may include a light-emitting element EL driven by a pixel circuit. The light-emitting element EL may include a red (R) light-emitting element, a green (G) light-emitting element, and a blue (B) light-emitting element. In another embodiment, the light-emitting element layer 14 may include a white light-emitting element and a color filter. The light-emitting elements EL in the light-emitting element layer 14 may be covered with a multi-protective layer in which an organic layer and an inorganic layer are stacked.

The encapsulation layer 16 covers the light-emitting element layer 14 so as to seal the circuit layer 12 and the light-emitting element layer 14. The encapsulation layer 16 may have a multi-insulating film structure in which an organic film and an inorganic film are alternately stacked. The inorganic film blocks the penetration of moisture or oxygen. The organic film flattens the surface of the inorganic film. If the organic film and the inorganic film are stacked in multiple layers, the travel path of moisture or oxygen becomes longer compared to that of a single layer, and thus, the penetration of moisture and oxygen affecting the light-emitting element layer 14 can be effectively blocked.

A touch sensor layer omitted from the drawing may be formed on the encapsulation layer 16, and a polarizing plate or a color filter layer may be disposed thereon. The touch sensor layer may include capacitive touch sensors that sense a touch input based on a change in capacitance before and after the touch input. The touch sensor layer may include metal wiring patterns and insulating films that form the capacitance of the touch sensors. The insulating films may insulate intersecting portions in the metal wiring patterns and may flatten the surface of the touch sensor layer. The polarizing plate can improve the visibility and contrast ratio by converting the polarization of external light reflected by the metal of the touch sensor layer and the circuit layer. The polarizing plate may be implemented with a polarizing plate in which a linear polarizing plate and a phase retardation film are bonded, or with a circular polarizing plate. A cover glass may be adhered onto the polarizing plate. The color filter layer may include red, green, and blue color filters. The color filter layer may further include a black matrix pattern. The color filter layer may absorb part of the wavelength of the light reflected from the circuit layer and the touch sensor layer to substitute for the role of the polarizing plate, and may enhance the color purity of an image reproduced in the pixel array.

The pixel array includes a plurality of pixel lines L1 to Ln. Each of the pixel lines L1 to Ln includes one line of pixels arranged along the line direction (X-axis direction) in the pixel array of the display panel 100. Pixels arranged in one pixel line share gate lines 103. Subpixels arranged in the column direction Y along the data line direction share the same data line 102. One horizontal period 1H is a time obtained by dividing one frame period by the total number of pixel lines L1 to Ln.

The display panel 100 may be implemented with a non-transmissive display panel or a transmissive display panel. The transmissive display panel may be applied to a transparent display device in which an image is displayed on a screen and an actual object in the background is visible. The display panel 100 may be made of a flexible display panel.

Each of the pixels 101 may be divided into a red subpixel, a green subpixel, and a blue subpixel to realize colors. Each of the pixels may further include a white subpixel. Each of the subpixels includes a pixel circuit. In the following, a pixel may be interpreted as the same meaning as a subpixel. Each of the pixel circuits is connected to the data line, gate lines, and power lines.

The pixels may be arranged in real color pixels and pentile pixels. The pentile pixel may realize a higher resolution than the real color pixel by driving two subpixels that are different in colors as one pixel 101 by using a preset pixel rendering algorithm. The pixel rendering algorithm can compensate for the color representation lacking in each of the pixels with the color of the light emitted from an adjacent pixel.

The power supply 140 generates direct current (DC) power necessary for driving the pixel array of the display panel 100 and the display panel driver by using a DC-DC converter. The DC-DC converter may include a charge pump, a regulator, a buck converter, a boost converter, and the like. The power supply 140 may adjust the level of a DC input voltage applied from a host system not shown, and may thus generate a DC voltage (or constant voltage) such as a gamma reference voltage VGMA, gate-on voltages VGH and VEH, gate-off voltages VGL and VEL, a pixel driving voltage ELVDD, a low-potential power supply voltage ELVSS, a reference voltage Vref, and an initialization voltage Vinit. The gamma reference voltage VGMA is supplied to a data driver 110. The gate-on voltages VGH and VEH and the gate-off voltages VGL and VEL are supplied to the gate driver 120. The pixel driving voltage ELVDD, the low-potential power supply voltage ELVSS, the reference voltage Vref, and the initialization voltage Vinit are commonly supplied to the pixels.

The display panel driver writes pixel data of an input image onto the pixels of the display panel 100 under the control of a timing controller (TCON) 130.

The display panel driver includes the data driver 110 and the gate driver 120. The display panel driver may further include a demultiplexer array 112 disposed between the data driver 110 and the data lines 102.

The demultiplexer array 112 sequentially supplies the data voltages outputted from the channels of the data driver 110 to the data lines 102 by using a plurality of demultiplexers DEMUX. The demultiplexer may include a plurality of switch elements disposed on the display panel 100. If the demultiplexer is disposed between the output terminals of the data driver 110 and the data lines 102, the number of channels in the data driver 110 may be reduced. The demultiplexer array 112 may be omitted.

The display panel driver may further include a touch sensor driver for driving the touch sensors. The touch sensor driver is omitted from FIG. 1. The data driver and the touch sensor driver may be integrated into one drive IC (integrated circuit). The timing controller 130, the power supply 140, the data driver 110, and the like in a mobile device or a wearable device may be integrated into one drive IC.

The display panel driver may operate in a low-speed driving mode under the control of the timing controller 130. The low-speed driving mode may be set to reduce the power consumption of the display device when an input image is analyzed and the input image does not change as much as a preset number of frames. The low-speed driving mode can reduce the power consumption of the display panel driver and the display panel 100 by lowering the refresh rate of pixels when a still image is inputted for a predetermined time or longer. The low-speed driving mode is not limited to when a still image is inputted. For example, when the display device operates in a standby mode or when a user command or input image is not inputted to the display panel driving circuit for a predetermined time or longer, the display panel driving circuit may operate in the low-speed driving mode.

The data driver 110 converts the pixel data of an input image, which is received in a digital signal from the timing controller 130 for each frame period, into a gamma compensation voltage by using a digital to analog converter (DAC), and thus generates a data voltage. The gamma reference voltage VGMA is divided into a gamma compensation voltage for each gray scale through a voltage divider circuit. The gamma compensation voltage for each gray scale is provided to a DAC of the data driver 110. The data voltage is outputted through an output buffer in each of the channels of the data driver 110.

The gate driver 120 may be implemented with a GIP (gate in panel) circuit formed directly on the display panel 100 together with a TFT array and wiring of the pixel array. The GIP circuit may be disposed on bezel areas BZ, which are non-display areas of the display panel 100, or may be disposed in a distributed manner in the pixel array in which an input image is reproduced. The gate driver 120 sequentially outputs gate signals to the gate lines 103 under the control of the timing controller 130. The gate driver 120 may sequentially supply the gate signals to the gate lines 103 by shifting the gate signals by using a shift register. The gate signal may include a scan signal and an emission control signal (hereinafter, referred to as an "EM signal") in an organic light-emitting display device. The scan signal includes a scan pulse that swings between the gate-on voltage VGH and the gate-off voltage VGL. The EM signal may include an EM pulse that swings between the gate-on voltage VEH and the gate-off voltage VEL. The scan pulse selects pixels in the pixel line to which data are to be written in synchronization with the data voltage. The EM signal controls the light-emitting times of pixels.

The gate driver 120 may include a first gate driver 121 and a second gate driver 122. The first gate driver 121 outputs a scan pulse in response to a start pulse and a shift clock from the timing controller 130, and shifts the scan pulse according to the shift clock timing. The second gate driver 122 outputs an EM pulse in response to a start pulse and a shift clock from the timing controller 130, and sequentially shifts the EM pulse according to the shift clock.

The timing controller 130 receives digital video data (DATA) of an input image and a timing signal synchronized therewith from a host system. The timing signal may include a vertical synchronization signal (Vsync), a horizontal synchronization signal (Hsync), a clock (CLK), a data enable signal (DE), and the like. Since the vertical period and the horizontal period can be known by a method of counting the data enable signals (DE), the vertical synchronization signal (Vsync) and the horizontal synchronization signal (Hsync) may be omitted. The data enable signal (DE) has a period of one horizontal period 1H.

The host system may be any one of a television (TV) system, a tablet computer, a laptop computer, a navigation system, a personal computer (PC), a home theater system, a mobile device, a wearable device, and a vehicle system. The host system may scale an image signal from a video source so as to match the resolution of the display panel 100 and transmit it to the timing controller 130 together with the timing signal.

The timing controller 130 may multiply an input frame frequency by i in a normal driving mode, and control the operation timing of the display panel driver with a frame frequency of the input frame frequency×i (i is a natural number) Hz. The input frame frequency is 60 Hz in the NTSC (National Television Standards Committee) method and 50 Hz in the PAL (Phase-Alternating Line) method.

The timing controller 130 lowers the frame frequency (or a data refresh frame rate) at which pixel data are written onto pixels in the low-speed driving mode compared to the normal driving mode. For example, the data refresh frame frequency at which the pixel data are written onto pixels in the normal driving mode may be generated at a frequency of 60 Hz or higher, e.g., at a refresh rate of any one of 60 Hz, 120 Hz, and 144 Hz, and the data refresh frame DRF in the low-speed driving mode may be generated at a refresh rate of a frequency lower than that in the normal driving mode. For example, the timing controller 130 may lower the driving frequency of the display panel driver by decreasing the frame frequency to a frequency between 1 Hz and 30 Hz in order to lower the refresh rate of pixels in the low-speed driving mode.

The timing controller 130 generates a data timing control signal for controlling the operation timing of the data driver 110, a control signal for controlling the operation timing of the demultiplexer array 112, and a gate timing control signal for controlling the operation timing of the gate driver 120, based on the timing signals (Vsync, Hsync, and DE) received from the host system. The timing controller 130 controls the operation timing of the display panel driver, and thereby, synchronizes the data driver 110, the demultiplexer array 112, the touch sensor driver, and the gate driver 120.

The voltage level of the gate timing control signal outputted from the timing controller 130 may be converted into the gate-on voltages VGH and VEH and the gate-off voltages VGL and VEL through a level shifter that is not shown, and supplied to the gate driver 120. The level shifter converts a low-level voltage of the gate timing control signal into the gate-off voltages VGL and VEL, and converts a high-level voltage of the gate timing control signal into the gate-on voltages VGH and VEH. The gate timing control signal includes a start pulse and a shift clock.

There may be differences in electrical characteristics of the driving element between pixels due to device characteristic variations and process variations caused in the manufacturing process of the display panel 100, and these differences may grow larger as the driving time of pixels elapses. In order to compensate for variations in electrical characteristics of the driving element between pixels, an internal compensation technique or an external compensation technique may be applied to the organic light-emitting display device. The internal compensation technique samples the threshold voltage of the driving element for each subpixel by using an internal compensation circuit implemented in each of the pixel circuits, and thereby compensates the gate-source voltage Vgs of the driving element by the threshold voltage. The external compensation technique senses in real-time the current or voltage of the driving element that changes according to the electrical characteristics of the driving element by using an external compensation circuit. The external compensation technique compensates in real-time for the variations (or changes) in electrical characteristics of the driving element in each of the pixels by modulating the pixel data (digital data) of the input image by the amount of the variations (or changes) in electrical characteristics of the driving element sensed for each pixel. The display panel driver may drive the pixels by using the external compensation technique and/or the internal compensation technique. The pixel circuit of the present disclosure may include a circuit to which the internal compensation technique is applied.

Figure 3:
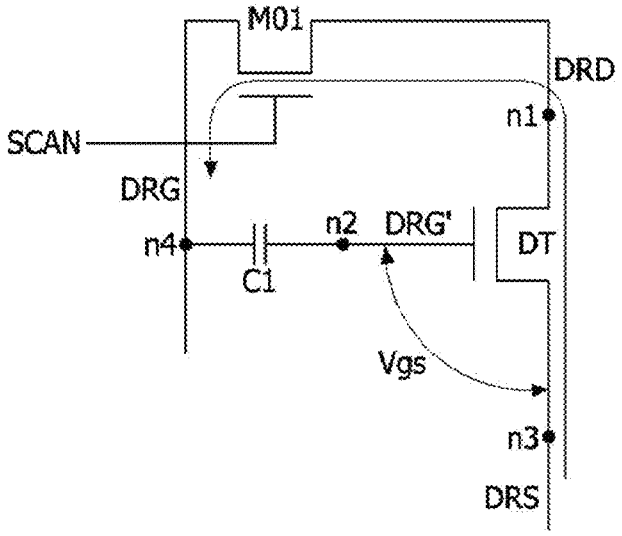
FIG. 3 is a circuit diagram showing a pixel circuit in accordance with a first embodiment of the present disclosure.

FIG. 3 is a circuit diagram showing a pixel circuit in accordance with a first embodiment of the present disclosure.

Referring to FIG. 3, the pixel circuit includes a driving element DT, a switch element M01 connected between a gate electrode and a first electrode of the driving element DT, and a capacitor C1 connected between the gate electrode of the driving element DT and a first electrode of the switch element M01. The driving element DT and the switch element M01 may be implemented with n-channel transistors.

The driving element DT generates a current for driving a light-emitting element according to a gate-source voltage Vgs. The driving element DT includes a first electrode connected to a first node n1, a gate electrode connected to a second node n2, and a second electrode connected to a third node n3.

The switch element M01 includes a first electrode connected to a fourth node n4, a second electrode connected to the first node n1, and a gate electrode to which a scan pulse SCAN is applied.

The capacitor C1 is connected between the second node n2 and the fourth node n4.

In FIG. 3, "DRD" denotes the voltage of the first node n1 (or a drain voltage), "DRG" denotes the voltage of the second node n2 (or a gate voltage), and "DRS" denotes the voltage of the third node n3, respectively. "DRG" is the voltage of the fourth node n4 separated from the second node n2 with the capacitor C1 interposed therebetween.

The threshold voltage Vth of the driving element DT is sensed in a diode connection method in which the gate electrode and the second electrode are connected with the capacitor C1 interposed therebetween when the switch element M01 is turned on.

Figure 4A:
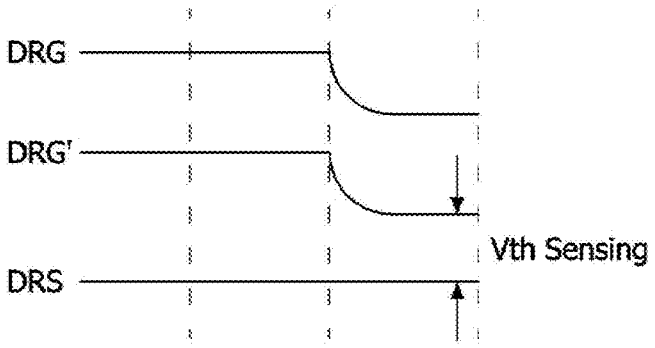
FIG. 4A is a waveform diagram showing an example in which the threshold voltage of a driving element is sensed when a gate-source voltage of the driving element is a positive voltage in the pixel circuit shown in FIG. 3.
Figure 4B:
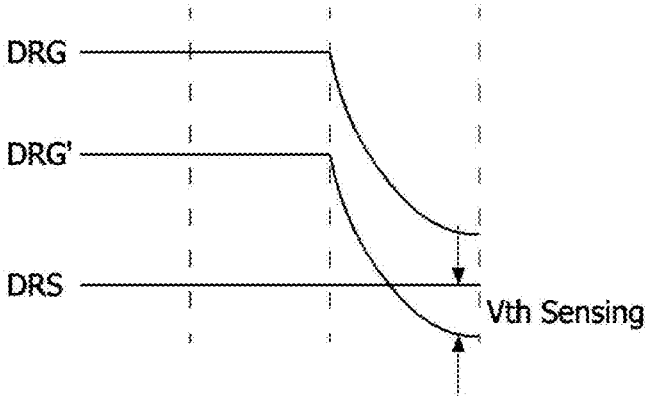
FIG. 4B is a waveform diagram showing an example in which the threshold voltage of a driving element is sensed when a gate-source voltage of the driving element is a negative voltage in the pixel circuit shown in FIG. 3.

In an initialization step of the pixel circuit, the switch element M01 is turned off, and the voltage DRG at the fourth node n4 is set to a voltage higher than the voltage DRG' at the second node n2 (DRG>DRG'). Accordingly, as shown in FIG. 4B, the threshold voltage of the driving element DT may be sensed even when the gate-source voltage Vgs of the driving element is a negative voltage, lower than 0[V].

In a sensing step, the switch element M01 is turned on, the driving element DT operates as a diode, and a voltage is applied to the third node n3. In the sensing step, when the gate-source voltage Vgs of the driving element DT reaches the threshold voltage Vth, the driving element DT is turned off. Due to the accumulation of stress in the driving element DT, the threshold voltage Vth of the driving element DT may be shifted to a positive voltage or a negative voltage. FIG. 4A is an example in which the threshold voltage Vth of the driving element DT is sensed when the gate-source voltage Vgs of the driving element DT is a positive voltage. FIG. 4B is an example in which the threshold voltage Vth of the driving element DT is sensed when the gate-source voltage Vgs of the driving element DT is a negative voltage. The threshold voltage Vth is a voltage difference DRG'−DRS between the second node n2 and the third node n3, i.e., the gate-source voltage Vgs, when the driving element DT is turned off.

Figure 5:
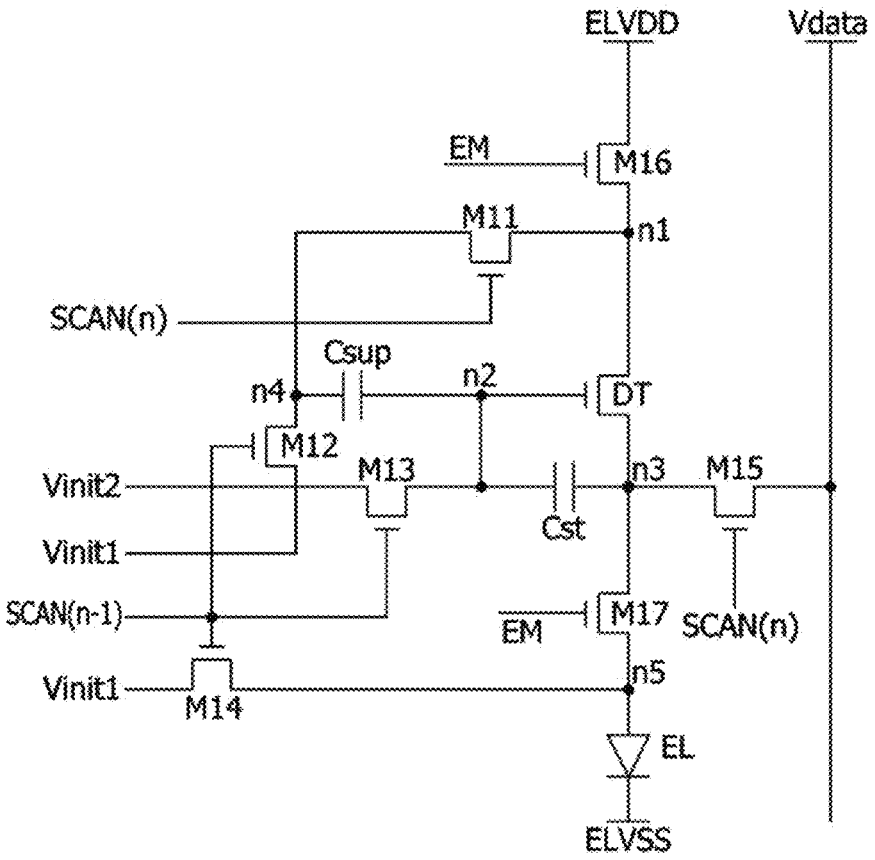
FIG. 5 is a circuit diagram showing a pixel circuit in accordance with a second embodiment of the present disclosure.
Figure 6:
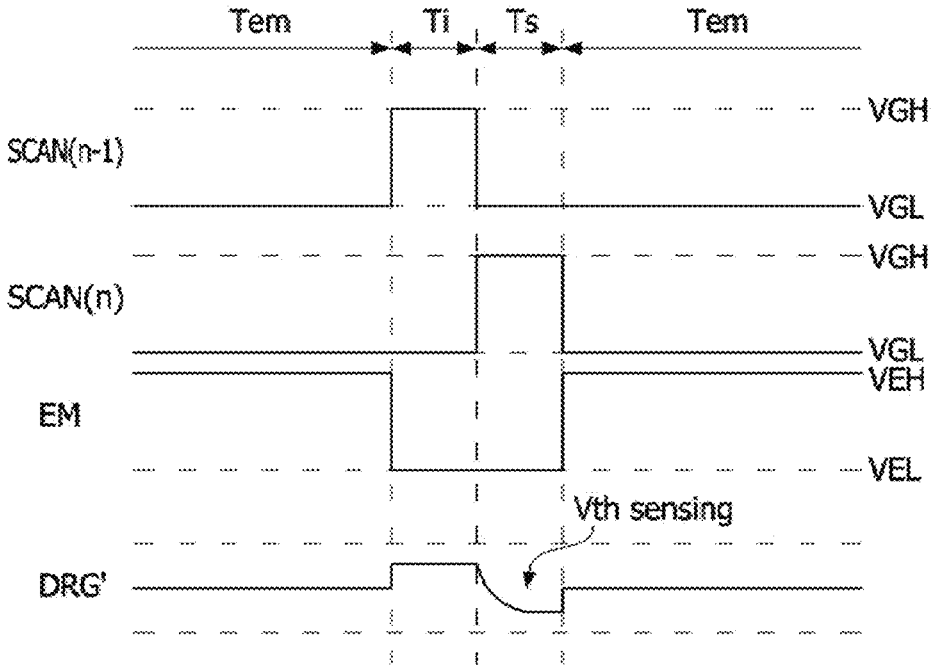
FIG. 6 is a waveform diagram showing gate signals applied to the pixel circuits shown in FIGS. 5 and 9 and gate voltages of a driving element.

FIG. 5 is a circuit diagram showing a pixel circuit in accordance with a second embodiment of the present disclosure. FIG. 6 is a waveform diagram showing gate signals applied to the pixel circuit shown in FIG. 5 and gate voltages of a driving element.

Referring to FIGS. 5 and 6, the pixel circuit includes a light-emitting element EL, a driving element DT, first to seventh switch elements M11 to M17, a first capacitor Csup, and a second capacitor Cst. The driving element DT and the switch elements M11 to M17 may be implemented with n-channel transistors.

This pixel circuit is connected to gate lines to which gate signals [SCAN(n−1), SCAN(n), and EM] are applied, and to a data line to which a data voltage Vdata is applied. Further, a first power line to which a pixel driving voltage ELVDD is applied, a second power line to which a first initialization voltage Vinit1 is applied, a third power line to which a second initialization voltage Vinit2 is applied, and a fourth power line to which a low-potential power supply voltage ELVSS is applied are connected to the pixel circuit.

The DC voltages applied to the pixel circuit may be set as ELVDD>Vinit1>Vinit2>ELVSS. Gate-on voltages VGH and VEH may be set to voltages higher than the pixel driving voltage ELVDD, and gate-off voltages VGL and VEL may be set to voltages lower than the low-potential power supply voltage ELVSS. The second initialization voltage Vinit2 may be set to a voltage lower than the first initialization voltage Vinit1 (Vinit1>Vini2). The first and second initialization voltages Vinit1 and Vinit2 may be set to voltages that satisfy the condition of Vinit1>2 (Vinit2−Vth). Here, "Vth" is the threshold voltage of the driving element DT. The second initialization voltage Vinit2 may be set to a voltage that is higher than the threshold voltage Vth of the driving element DT (Vinit2>Vth), or that is higher than the sum (Vdata+Vth) of the data voltage Vdata and the threshold voltage Vth of the driving element DT (Vinit2>Vdata+Vth).

The light-emitting element EL may include an anode electrode connected to a fifth node n5, a cathode electrode to which the low-potential power supply voltage ELVSS is applied, and an organic compound layer connected between the electrodes. The organic compound layer may include, but is not limited to, a hole injection layer HIL, a hole transport layer HTL, an emission layer EML, an electron transport layer ETL, and an electron injection layer EIL. When a voltage is applied to the anode and cathode electrodes, the holes that have passed through the hole transport layer HTL and the electrons that have passed through the electron transport layer ETL are moved to the emission layer EML, and excitons are formed and visible light is emitted from the emission layer EML. An organic light-emitting diode (OLED) used as the light-emitting element EL may be of a tandem structure in which a plurality of light-emitting layers are stacked. An OLED of the tandem structure can improve the luminance and lifespan of pixels.

The driving element DT generates a current for driving the light-emitting element EL according to the gate-source voltage Vgs. The driving element DT includes a first electrode connected to a first node n1, a gate electrode connected to a second node n2, and a second electrode connected to a third node n3.

The first capacitor Csup is connected between the second node n2 and a fourth node n4. The second capacitor Cst is connected between the second node n2 and the third node n3.

First and second scan pulses [SCAN(n−1), SCAN(n)] are generated as pulses of the gate-on voltage VGH, and have the same pulse width as each other. The first scan pulse [SCAN(n−1)] is generated in an initialization step Ti prior to the second scan pulse [SCAN(n)]. The second scan pulse [SCAN(n)] is generated in a sensing step Ts in synchronization with the data voltage Vdata.

An EM pulse EM is generated as the gate-off voltage VEL in the initialization step Ti and the sensing step Ts. The EM pulse EM is inverted to the gate-on voltage VEH in a light emission step Tem, and forms a current path between the pixel driving voltage ELVDD and the light-emitting element EL in at least some section of the light emission step Tem. The pulse width of the EM pulse EM may be set to a value higher than that of the scan pulses [SCAN(n−1), SCAN(n)]. For example, when the pulse width of the scan pulses [SCAN(n−1), SCAN(n)] is one horizontal period, the pulse width of the EM pulse EM may be two horizontal periods.

The first switch element M11 includes a first electrode connected to the fourth node n4, a second electrode connected to the first node n1, and a gate electrode to which the second scan pulse [SCAN(n)] is applied. The first switch element M11 is turned on according to the gate-on voltage VGH of the second scan pulse [SCAN(n)], and connects the first node n1 and the fourth node n4 in the sensing step Ts, thereby connecting the electrodes of the driving element DT in an indirect diode connection structure.

The second switch element M12 includes a first electrode connected to the fourth node n4, a second electrode to which the first initialization voltage Vinit1 is applied, and a gate electrode to which the first scan pulse [SCAN(n−1)] is applied. The second switch element M12 is turned on according to the gate-on voltage VGH of the first scan pulse [SCAN(n−1)], and thereby supplies the first initialization voltage Vinit1 to the fourth node n4 in the initialization step Ti.

The third switch element M13 includes a first electrode to which the second initialization voltage Vinit2 is applied, a second electrode connected to the second node n2, and a gate electrode to which the first scan pulse [SCAN(n−1)] is applied. The third switch element M13 is turned on according to the gate-on voltage VGH of the first scan pulse [SCAN(n−1)], and thereby supplies the second initialization voltage Vinit2 to the second node n2 in the initialization step Ti.

The fourth switch element M14 includes a first electrode to which the first initialization voltage Vinit1 is applied, a second electrode connected to the fifth node n5, and a gate electrode to which the first scan pulse [SCAN(n−1)] is applied. The fourth switch element M14 is turned on according to the gate-on voltage VGH of the first scan pulse [SCAN(n−1)], and thereby supplies the first initialization voltage Vinit1 to the fifth node n5 in the initialization step Ti.

The fifth switch element M15 includes a first electrode connected to the third node n3, a second electrode to which the data voltage Vdata is applied, and a gate electrode to which the second scan pulse [SCAN(n)] is applied. The fifth switch element M15 is turned on according to the gate-on voltage VGH of the second scan pulse [SCAN(n)], and thereby supplies the data voltage Vdata to the third node n3 in the sensing step Ts.

The sixth switch element M16 includes a first electrode to which the pixel driving voltage ELVDD is applied, a second electrode connected to the first node n1, and a gate electrode to which the EM pulse EM is applied. The sixth switch element M16 is turned off in the initialization step Ti and the sensing step Ts according to the gate-off voltage VEL of the EM pulse EM. The voltage of the gate line to which the EM pulse EM is applied is the gate-on voltage VEH in at least some section of the light emission step Tem. Accordingly, the sixth switch element M16 is turned on in at least some section of the light emission step Tem, and forms a current path between the pixel driving voltage ELVDD and the driving element DT.

The seventh switch element M17 includes a first electrode connected to the third node n3, a second electrode connected to the fifth node n5, and a gate electrode to which the EM pulse EM is applied. The seventh switch element M17 is turned off in the initialization step Ti and the sensing step Ts according to the gate-off voltage VEL of the EM pulse EM. The voltage of the gate line to which the EM pulse EM is applied is the gate-on voltage VEH in at least some section of the light emission step Tem. Accordingly, the seventh switch element M17 is turned on in at least some section of the light emission step Tem, and forms a current path between the driving element DT and the light-emitting element EL.

Figure 7A:
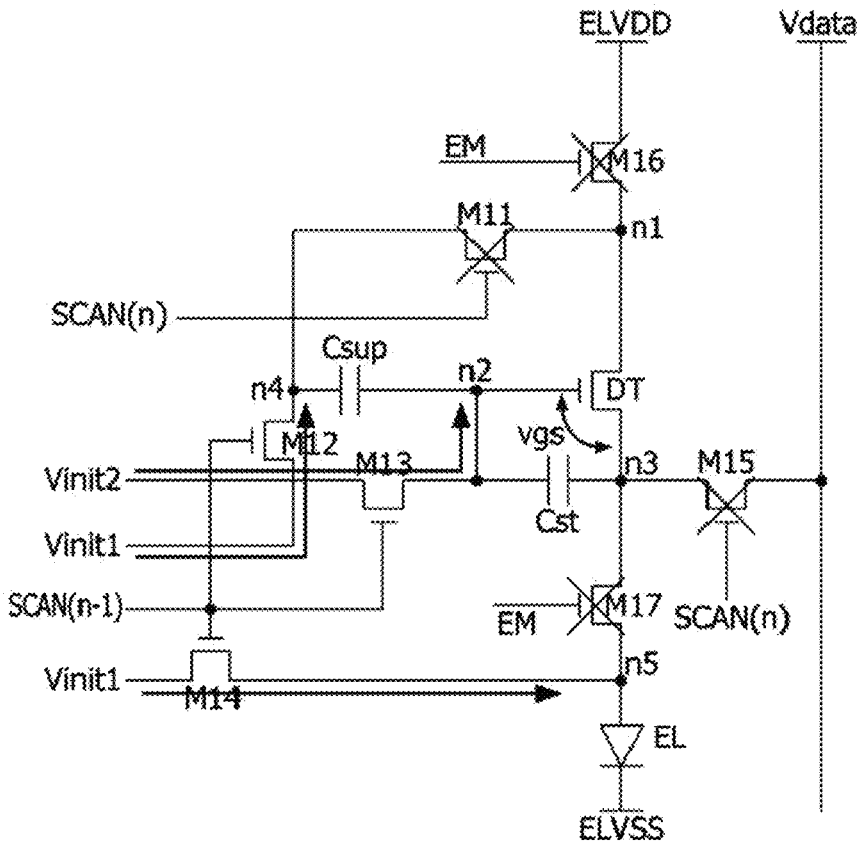
FIG. 7A is a circuit diagram showing switch elements that are turned on/off and a current flow therethrough in an initialization step of the pixel circuit shown in FIG. 5.

In the initialization step Ti, the first scan pulse [SCAN(n−1)] is generated as the gate-on voltage VGH. At this time, the second scan pulse [SCAN(n)] and the EM pulse EM are at the gate-off voltages VGL and VEL. In the initialization step Ti, as shown in FIG. 7A, the second, third, and fourth switch elements M12, M13, and M14 are turned on, and the fourth node n4 is initialized to the first initialization voltage Vinit1 and the second node n2 is initialized to the second initialization voltage Vinit2 lower than the first initialization voltage Vinit1, respectively. In the initialization step Ti, the driving element DT is turned on as the gate-source voltage Vgs is set to the threshold voltage Vth or higher. The fifth node n5 is initialized to the first initialization voltage Vinit1 in the initialization step Ti.

Figure 8A:
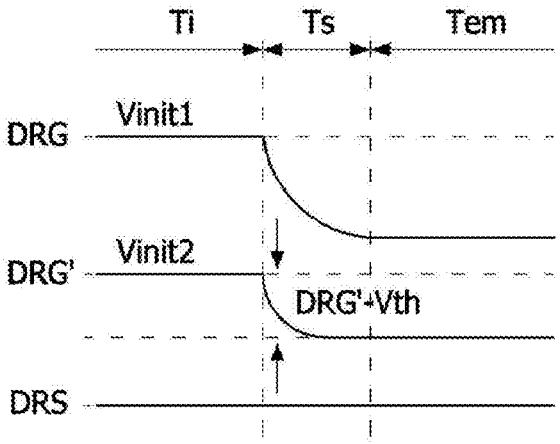
FIG. 8A is a waveform diagram showing an example in which the threshold voltage of a driving element is sensed when a gate-source voltage of the driving element is a positive voltage in the pixel circuit shown in FIG. 5.
Figure 8B:
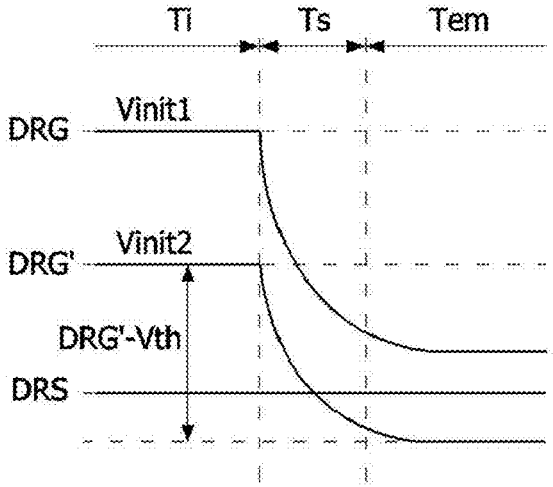
FIG. 8B is a waveform diagram showing an example in which the threshold voltage of a driving element is sensed when a gate-source voltage of the driving element is a negative voltage in the pixel circuit shown in FIG. 5.

As a result of the initialization step Ti, the voltage DRG of the fourth node n4 is initialized to the first initialization voltage Vinit1, and the voltage DRG' of the second node n2 is initialized to the second initialization voltage Vinit2 lower than the first initialization voltage Vinit1, as shown in FIGS. 8A and 8B. The waveforms in FIGS. 8A and 8B show voltage changes of the second, third, and fourth nodes n2, n3, and n4 in the initialization step Ti and the sensing step Ts when the first and second capacitors Csup and Cst have the same capacitance.

Figure 7B:
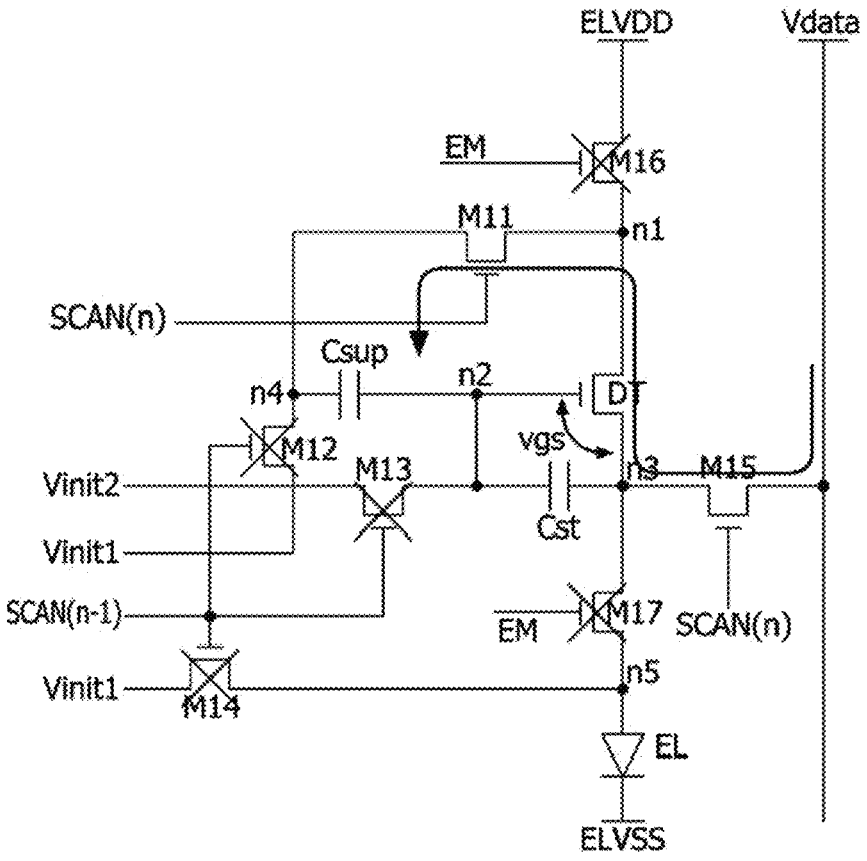
FIG. 7B is a circuit diagram showing switch elements that are turned on/off and a current flow therethrough in a sensing step of the pixel circuit shown in FIG. 5.

In the sensing step Ts, the second scan pulse [SCAN(n)] synchronized with the data voltage Vdata is generated as the gate-on voltage VGH. The data voltage Vdata is applied to the pixel circuit through the data line and the fifth switch element M15 in the sensing step, so that pixel data are written onto subpixels. The first scan pulse [SCAN(n−1)] and the EM pulse EM are at the gate-off voltages VGL and VEL in the sensing step Ts. In the sensing step Ts, as shown in FIG. 7B, the first and fifth switch elements M11 and M15 are turned on, so that the data voltage Vdata is applied to the third node n3, the driving element DT, the first node n1, and the fourth node n4. In the sensing step Ts, the voltages of the second and fourth nodes n2 and n4 are reduced by means of the data voltage Vdata as shown in FIGS. 8A and 8B. In the sensing step Ts, when the difference between the voltages DRG' and DRS of the second node n2 and the third node n3 reaches the threshold voltage Vth of the driving element DT, the driving element DT is turned off and the threshold voltage Vth of the driving element DT is stored in the second capacitor Cst.

As a result of the sensing step Ts, the voltage DRG' of the second node n2 is Vdata+Vth, and the voltage DRG of the fourth node n4 is (Vinit1−Vinit2)+Vdata+Vth. In the sensing step Ts, the voltage DRG of the fourth node n4 may change by 2(DRG'−Vth) as shown in FIGS. 8A and 8B. The voltage DRS of the third node n3 is the data voltage Vdata. As a result of the sensing step Ts, the gate-source voltage Vgs of the driving element DT is stored in the second capacitor Cst. The threshold voltage Vth of the driving element DT can be sensed even if the gate-source voltage Vgs of the driving element DT is shifted to a positive voltage or to a negative voltage.

Figure 7C:
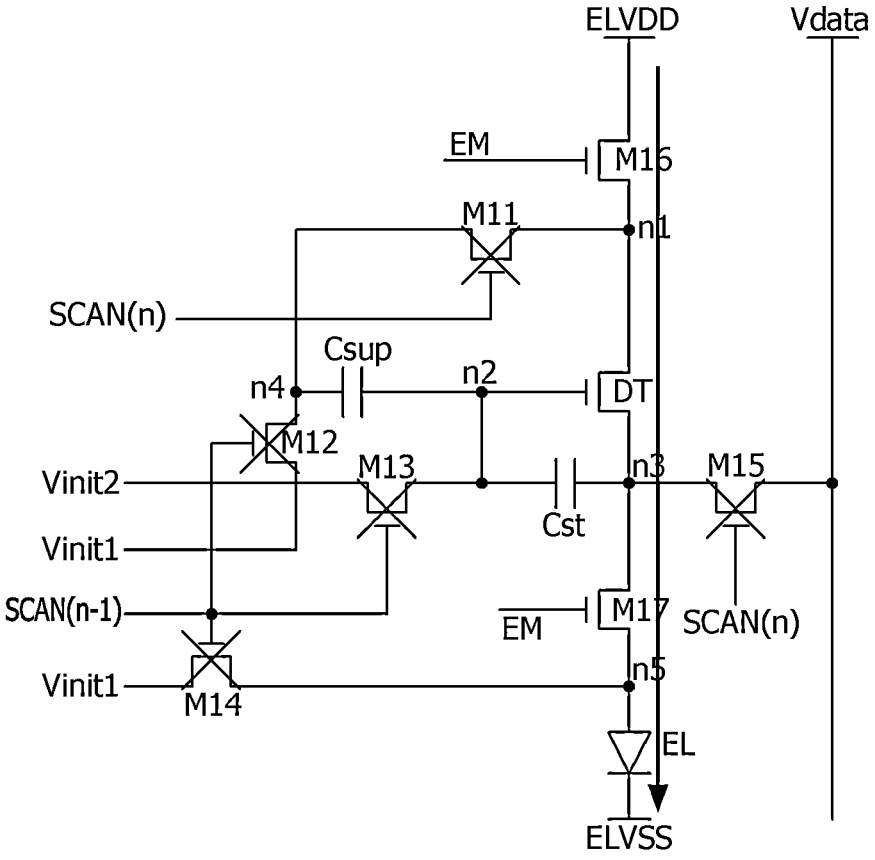
FIG. 7C is a circuit diagram showing switch elements that are turned on/off and a current flow therethrough in a light emission step of the pixel circuit shown in FIG. 5.

In the light emission step Tem, the EM pulse EM is inverted to the gate-on voltage VEH. The first and second scan pulses [SCAN(n−1), SCAN(n)] are at the gate-off voltage VGL in the light emission step Tem. In the light emission step Tem, as shown in FIG. 7C, the sixth and seventh switch elements M16 and M17 are turned on, whereas the other switch elements M11 to M15 are turned off. In the light emission step Tem, a current is supplied to the light-emitting element EL according to the gate-source voltage Vgs of the driving element DT stored in the second capacitor Cst. In the light emission step Tem, the light-emitting element EL emits light at a target luminance corresponding to the gray scale of the pixel data by the current supplied through the driving element DT.

In the pixel circuit shown in FIGS. 5 to 7C, the first and second capacitors Csup and Cst are connected in parallel to the second node n2, and thus, the voltage ΔDRG' of the second node n2 that is changed by the voltage division of these capacitors Csup and Cst is $$\Delta DRG' = \frac{C_{sup}}{C_{sup} + C_{st}} \times \Delta DRG.$$

ΔDRG is the voltage at the fourth node n4. The first and second capacitors Csup and Cst may be implemented with two metal layers facing each other with an insulating layer interposed therebetween in FIG. 16 as viewed from the cross-sectional structure of the display panel 100.

Figure 9:
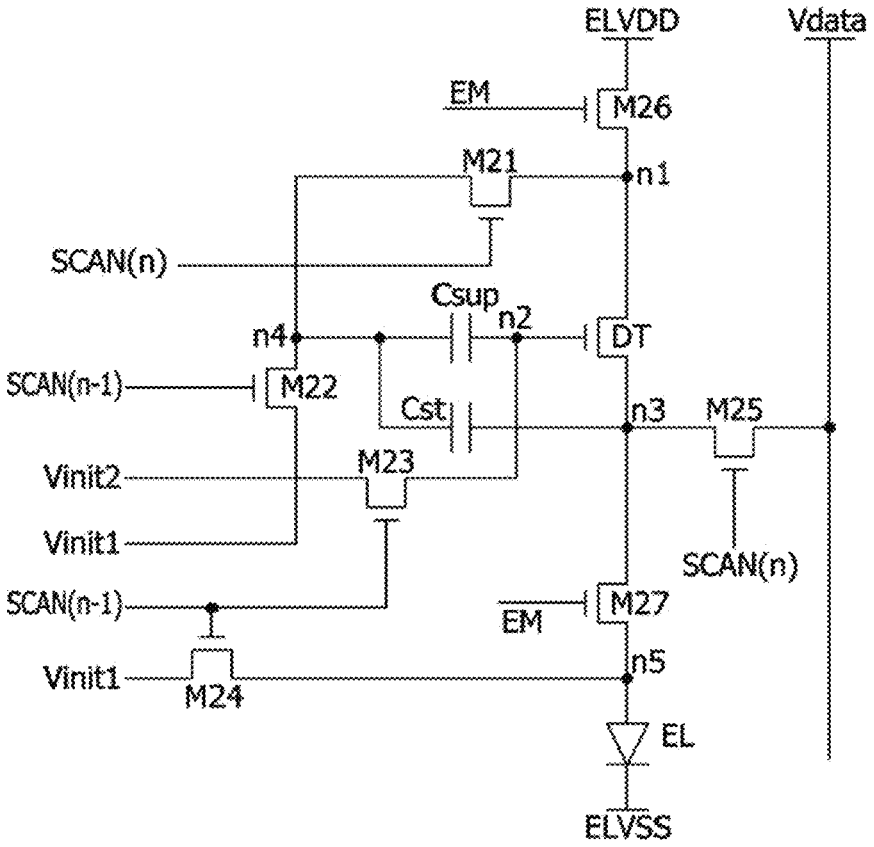
FIG. 9 is a circuit diagram showing a pixel circuit in accordance with a third embodiment of the present disclosure.

FIG. 9 is a circuit diagram showing a pixel circuit in accordance with a third embodiment of the present disclosure. Gate signals of the pixel circuit shown in FIG. 9 are the same as those of FIG. 6.

Referring to FIGS. 6 and 9, the pixel circuit includes a light-emitting element EL, a driving element DT, first to seventh switch elements M21 to M27, a first capacitor Csup, and a second capacitor Cst. The driving element DT and the switch elements M21 to M27 may be implemented with n-channel transistors.

This pixel circuit is connected to gate lines to which gate signals [SCAN(n−1), SCAN(n), EM] are applied, and to a data line to which a data voltage Vdata is applied. Further, a first power line to which a pixel driving voltage ELVDD is applied, a second power line to which a first initialization voltage Vinit1 is applied, a third power line to which a second initialization voltage Vinit2 is applied, and a fourth power line to which a low-potential power supply voltage ELVSS is applied are connected to the pixel circuit.

The DC voltages applied to the pixel circuit may be set as ELVDD>Vinit1>Vinit2>ELVSS. Gate-on voltages VGH and VEH may be set to voltages higher than the pixel driving voltage ELVDD, and gate-off voltages VGL and VEL may be set to voltages lower than the low-potential power supply voltage ELVSS. The second initialization voltage Vinit2 may be set to a voltage lower than the first initialization voltage Vinit1 (Vinit1>Vini2). The first and second initialization voltages Vinit1 and Vinit2 may be set to voltages that satisfy the condition of Vinit1>2 (Vinit2−Vth). Here, "Vth" is the threshold voltage of the driving element DT. The second initialization voltage Vinit2 may be set to a voltage that is higher than the threshold voltage Vth of the driving element DT (Vinit2>Vth), or that is higher than the sum (Vdata+Vth) of the data voltage Vdata and the threshold voltage Vth of the driving element DT (Vinit2>Vdata+Vth).

The light-emitting element EL may include an anode electrode connected to a fifth node n5, a cathode electrode to which the low-potential power supply voltage ELVSS is applied, and an organic compound layer connected between the electrodes. The driving element DT includes a first electrode connected to a first node n1, a gate electrode connected to a second node n2, and a second electrode connected to a third node n3.

The first capacitor Csup is connected between the second node n2 and a fourth node n4. The second capacitor Cst is connected between the fourth node n4 and the third node n3. The first and second capacitors Csup and Cst may be connected in series between the second node n2 and the third node n3, so that their sizes may become larger. By the voltage division of the first and second capacitors Csup and Cst connected in series, the dynamic range of the data voltage Vdata may increase, thereby improving the unevenness at low gray scale.

First and second scan pulses [SCAN(n−1), SCAN(n)] are generated as pulses of the gate-on voltage VGH, and have the same pulse width as each other. The first scan pulse [SCAN(n−1)] is generated in an initialization step Ti prior to the second scan pulse [SCAN(n)]. The second scan pulse [SCAN(n)] is generated in a sensing step Ts in synchronization with the data voltage Vdata.

An EM pulse EM is generated as the gate-off voltage VEL in the initialization step Ti and the sensing step Ts. The EM pulse EM is inverted to the gate-on voltage VEH in a light emission step Tem, and forms a current path between the pixel driving voltage ELVDD and the light-emitting element EL in at least some section of the light emission step Tem. The pulse width of the EM pulse EM may be set to a value higher than that of the scan pulses [SCAN(n−1), SCAN(n)]. For example, when the pulse width of the scan pulses [SCAN(n−1), SCAN(n)] is one horizontal period, the pulse width of the EM pulse EM may be two horizontal periods.

The first switch element M21 includes a first electrode connected to the fourth node n4, a second electrode connected to the first node n1, and a gate electrode to which the second scan pulse [SCAN(n)] is applied. The first switch element M21 is turned on according to the gate-on voltage VGH of the second scan pulse [SCAN(n)], and connects the first node n1 and the fourth node n4 in the sensing step Ts, thereby connecting the electrodes of the driving element DT in an indirect diode connection structure.

The second switch element M22 includes a first electrode connected to the fourth node n4, a second electrode to which the first initialization voltage Vinit1 is applied, and a gate electrode to which the first scan pulse [SCAN(n−1)] is applied. The second switch element M22 is turned on according to the gate-on voltage VGH of the first scan pulse [SCAN(n−1)], and thereby supplies the first initialization voltage Vinit1 to the fourth node n4 in the initialization step Ti.

The third switch element M23 includes a first electrode to which the second initialization voltage Vinit2 is applied, a second electrode connected to the second node n2, and a gate electrode to which the first scan pulse [SCAN(n−1)] is applied. The third switch element M23 is turned on according to the gate-on voltage VGH of the first scan pulse [SCAN(n−1)], and thereby supplies the second initialization voltage Vinit2 to the second node n2 in the initialization step Ti.

The fourth switch element M24 includes a first electrode to which the first initialization voltage Vinit1 is applied, a second electrode connected to the fifth node n5, and a gate electrode to which the first scan pulse [SCAN(n−1)] is applied. The fourth switch element M24 is turned on according to the gate-on voltage VGH of the first scan pulse [SCAN(n−1)], and thereby supplies the first initialization voltage Vinit1 to the fifth node n5 in the initialization step Ti.

The fifth switch element M25 includes a first electrode connected to the third node n3, a second electrode to which the data voltage Vdata is applied, and a gate electrode to which the second scan pulse [SCAN(n)] is applied. The fifth switch element M25 is turned on according to the gate-on voltage VGH of the second scan pulse [SCAN(n)], and thereby supplies the data voltage Vdata to the third node n3 in the sensing step Ts.

The sixth switch element M26 includes a first electrode to which the pixel driving voltage ELVDD is applied, a second electrode connected to the first node n1, and a gate electrode to which the EM pulse EM is applied. The sixth switch element M26 is turned off in the initialization step Ti and the sensing step Ts according to the gate-off voltage VEL of the EM pulse EM. The voltage of the gate line to which the EM pulse EM is applied is the gate-on voltage VEH in at least some section of the light emission step Tem. Accordingly, the sixth switch element M26 is turned on in at least some section of the light emission step Tem, and forms a current path between the pixel driving voltage ELVDD and the driving element DT.

The seventh switch element M27 includes a first electrode connected to the third node n3, a second electrode connected to the fifth node n5, and a gate electrode to which the EM pulse EM is applied. The seventh switch element M27 is turned off in the initialization step Ti and the sensing step Ts according to the gate-off voltage VEL of the EM pulse EM, and is turned on in the light emission step Tem. The seventh switch element M27 is turned on in at least some section of the light emission step Tem, and forms a current path between the driving element DT and the light-emitting element EL.

Figure 10A:
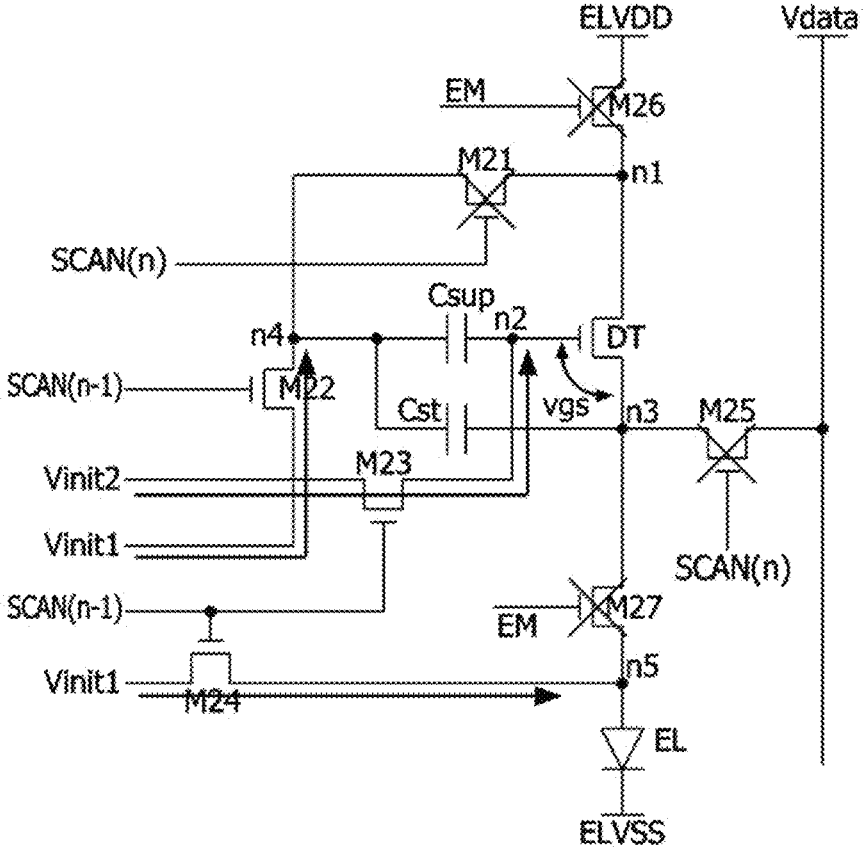
FIG. 10A is a circuit diagram showing switch elements that are turned on/off and a current flow therethrough in an initialization step of the pixel circuit shown in FIG. 9.

In the initialization step Ti, the first scan pulse [SCAN (n−1)] is generated as the gate-on voltage VGH. At this time, the second scan pulse [SCAN(n)] and the EM pulse EM are at the gate-off voltages VGL and VEL. In the initialization step Ti, as shown in FIG. 10A, the second, third, and fourth switch elements M22, M23, and M24 are turned on, and the fourth node n4 is initialized to the first initialization voltage Vinit1 and the second node n2 is initialized to the second initialization voltage Vinit2 lower than the first initialization voltage Vinit1, respectively. In the initialization step Ti, the driving element DT is turned on as the gate-source voltage Vgs is set to the threshold voltage Vth or higher. The fifth node n5 is initialized to the first initialization voltage Vinit1 in the initialization step Ti.

As a result of the initialization step Ti, the voltage DRG of the fourth node n4 is initialized to the first initialization voltage Vinit1, and the voltage DRG' of the second node n2 is initialized to the second initialization voltage Vinit2 lower than the first initialization voltage Vinit1, as shown in FIGS. 8A and 8B.

Figure 10B:
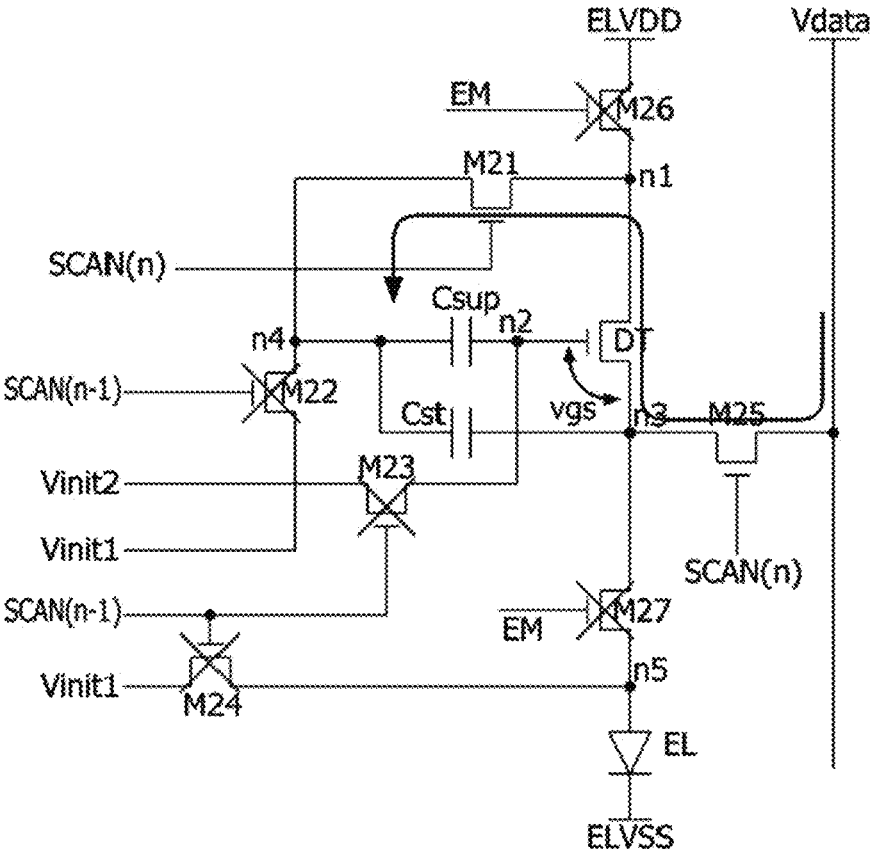
FIG. 10B is a circuit diagram showing switch elements that are turned on/off and a current flow therethrough in a sensing step of the pixel circuit shown in FIG. 9.

In the sensing step Ts, the second scan pulse [SCAN(n)] synchronized with the data voltage Vdata is generated as the gate-on voltage VGH. The data voltage Vdata is applied to the pixel circuit through the data line and the fifth switch element M25 in the sensing step. The first scan pulse [SCAN(n−1)] and the EM pulse EM are at the gate-off voltages VGL and VEL in the sensing step Ts. In the sensing step Ts, as shown in FIG. 10B, the first and fifth switch elements M21 and M25 are turned on, so that the data voltage Vdata is applied to the third node n3, the driving element DT, the first node n1, and the fourth node n4. In the sensing step Ts, the voltages of the second and fourth nodes n2 and n4 are reduced by means of the data voltage Vdata as shown in FIGS. 8A and 8B. In the sensing step Ts, when the difference between the voltages DRG' and DRS of the second node n2 and the third node n3 reaches the threshold voltage Vth of the driving element DT, the driving element DT is turned off and the threshold voltage Vth of the driving element DT is stored in the second capacitor Cst.

As a result of the sensing step Ts, the voltage DRG' of the second node n2 is Vdata+Vth, and the voltage DRG of the fourth node n4 is (Vinit1−Vinit2)+Vdata+Vth. In the sensing step Ts, the voltage DRG of the fourth node n4 may change by 2(DRG'−Vth) as shown in FIGS. 8A and 8B. The voltage DRS of the third node n3 is the data voltage Vdata. As a result of the sensing step Ts, the gate-source voltage Vgs of the driving element DT is stored in the second capacitor Cst. The threshold voltage Vth of the driving element DT can be sensed even if the gate-source voltage Vgs of the driving element DT is shifted to a positive voltage or to a negative voltage.

Figure 10C:
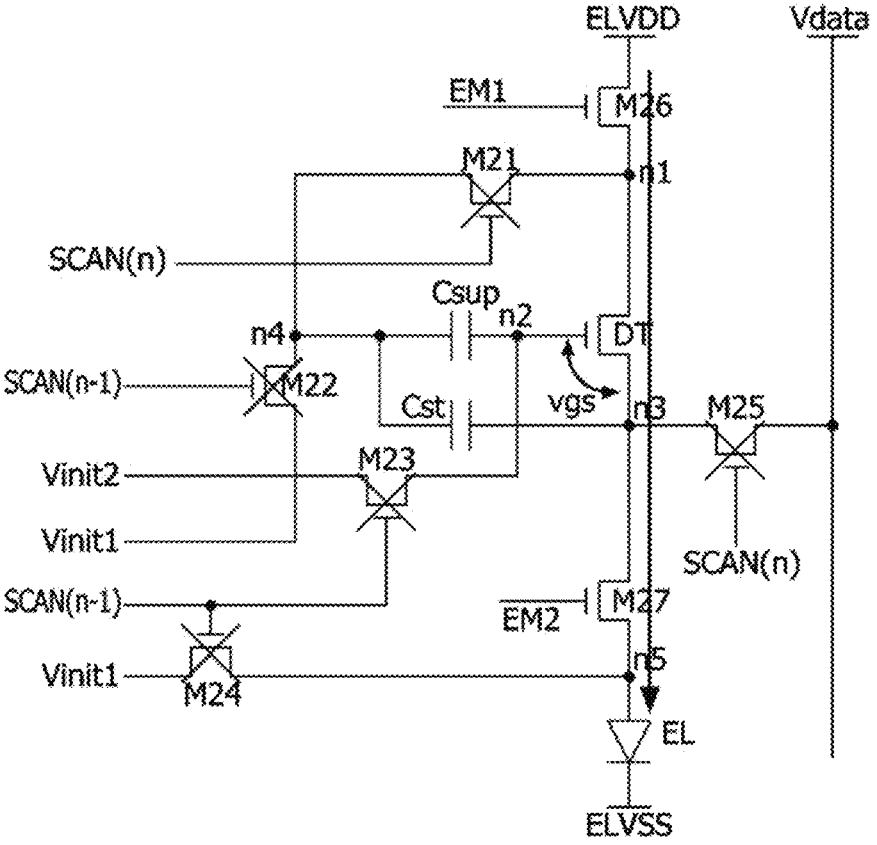
FIG. 10C is a circuit diagram showing switch elements that are turned on/off and a current flow therethrough in a light emission step of the pixel circuit shown in FIG. 9.

In the light emission step Tem, the EM pulse EM is inverted to the gate-on voltage VEH. The first and second scan pulses [SCAN(n−1), SCAN(n)] are at the gate-off voltage VGL in the light emission step Tem. In the light emission step Tem, as shown in FIG. 10C, the sixth and seventh switch elements M26 and M27 are turned on, whereas the other switch elements M21 to M25 are turned off. In the light emission step Tem, a current is supplied to the light-emitting element EL according to the gate-source voltage Vgs of the driving element DT stored in the second capacitor Cst. In the light emission step Tem, the light-emitting element EL emits light at a target luminance corresponding to the gray scale of the pixel data by the current supplied through the driving element DT.

Figure 16:
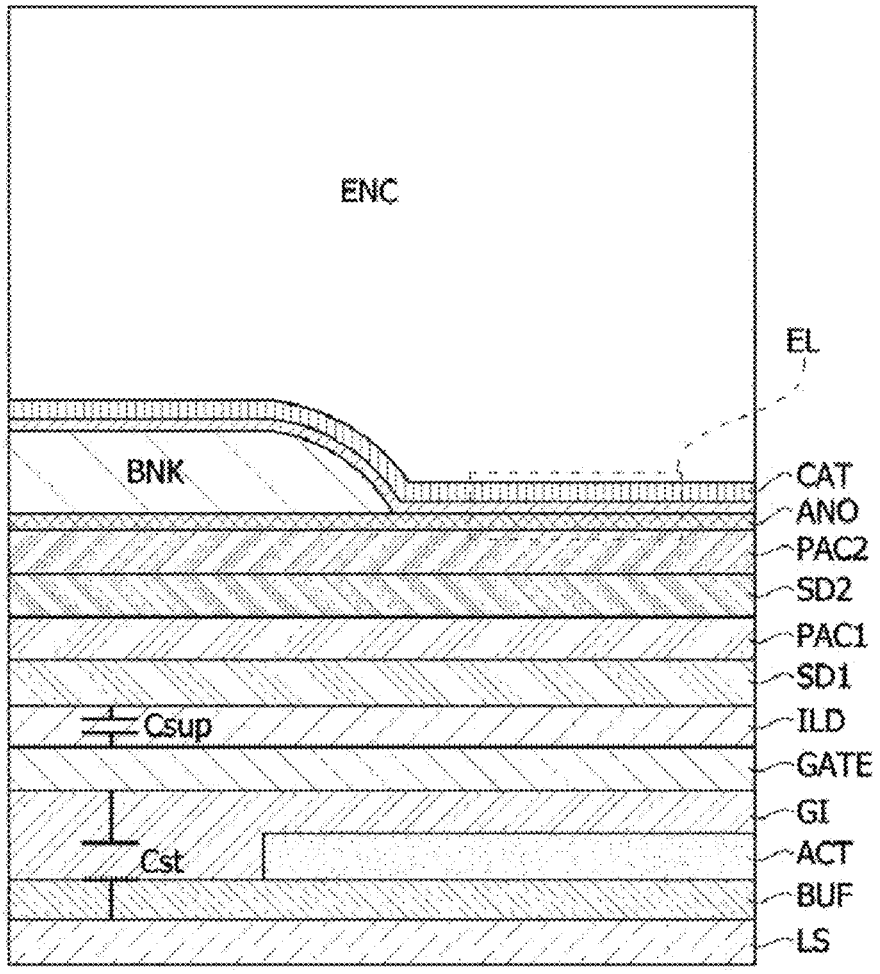
FIG. 16 is a cross-sectional view showing capacitors of a pixel circuit in a cross-sectional structure of a display panel in accordance with one embodiment of the present disclosure.

The first and second capacitors Csup and Cst may be implemented with two metal layers facing each other with an insulating layer interposed therebetween in FIG. 16 as viewed from the cross-sectional structure of the display panel 100.

Figure 11:
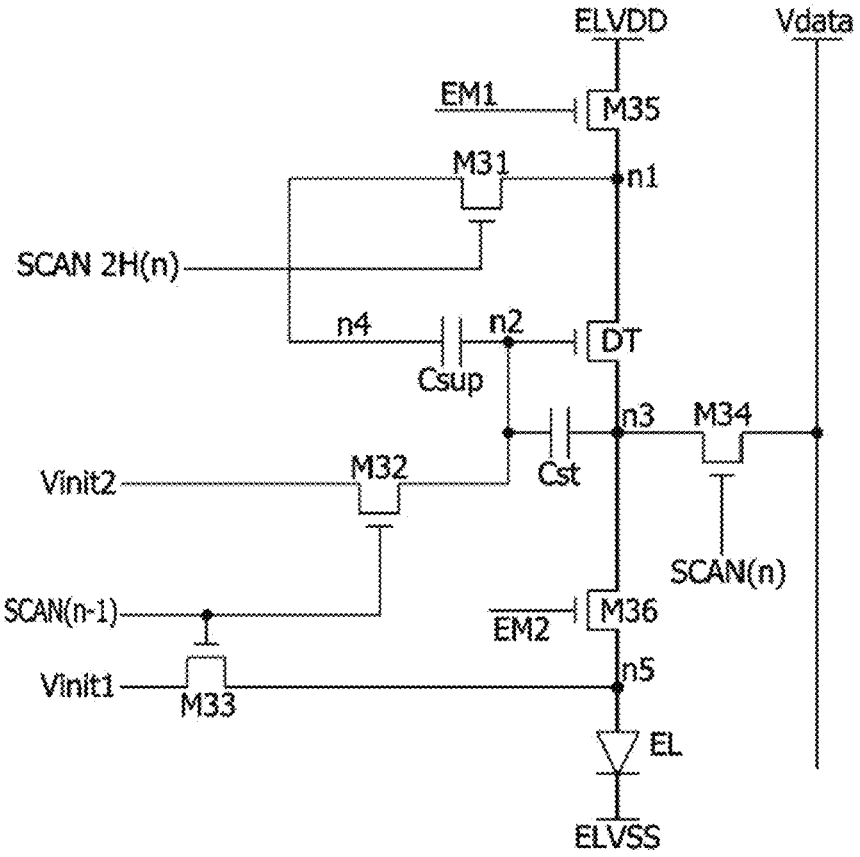
FIG. 11 is a circuit diagram showing a pixel circuit in accordance with a fourth embodiment of the present disclosure.
Figure 12:
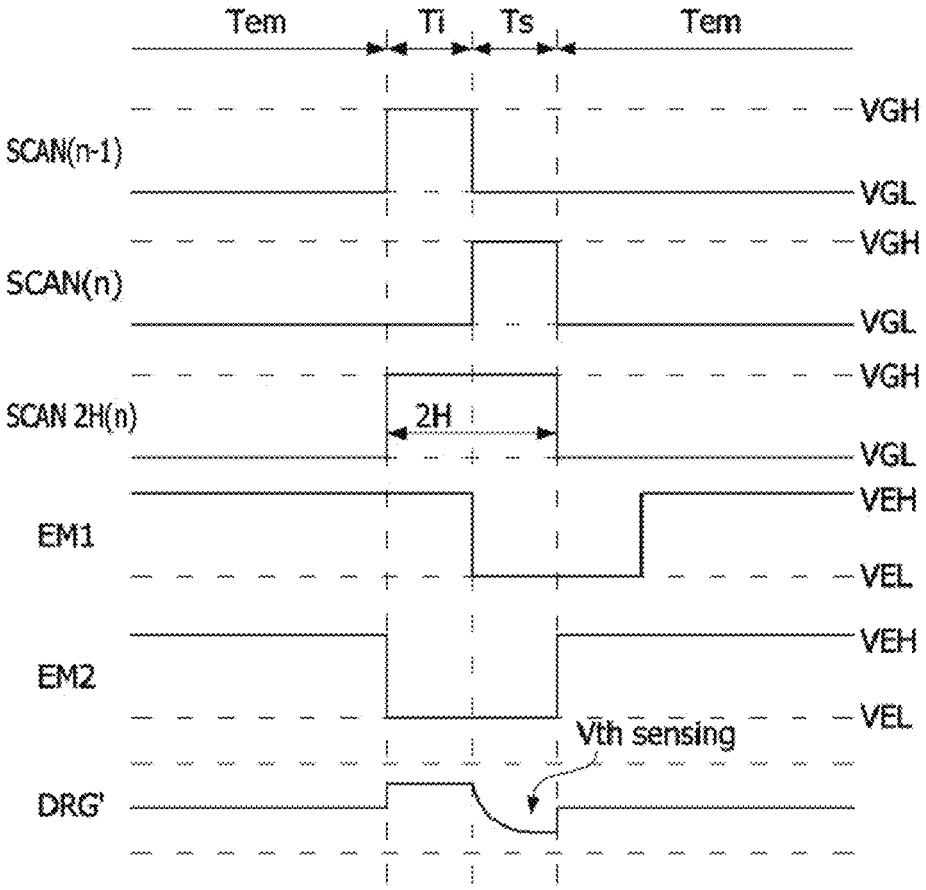
FIG. 12 is a waveform diagram showing gate signals applied to the pixel circuit shown in FIGS. 11 and 14 and gate voltages of a driving element.

FIG. 11 is a circuit diagram showing a pixel circuit in accordance with a fourth embodiment of the present disclosure. FIG. 12 is a waveform diagram showing gate signals applied to the pixel circuit shown in FIG. 11 and gate voltages of a driving element.

Referring to FIGS. 11 and 12, the pixel circuit includes a light-emitting element EL, a driving element DT, first to sixth switch elements M31 to M36, a first capacitor Csup, and a second capacitor Cst. The driving element DT and the switch elements M31 to M36 may be implemented with n-channel transistors.

This pixel circuit is connected to gate lines to which gate signals [SCAN(n−1), SCAN(n), SCAN2H(n), EM1, EM2] are applied, and to a data line to which a data voltage Vdata is applied. Further, a first power line to which a pixel driving voltage ELVDD is applied, a second power line to which a first initialization voltage Vinit1 is applied, a third power line to which a second initialization voltage Vinit2 is applied, and a fourth power line to which a low-potential power supply voltage ELVSS is applied are connected to the pixel circuit.

The first and second initialization voltages Vinit1 and Vinit2 may be set to voltages that are lower than the pixel driving voltage ELVDD and are higher than the low-potential power supply voltage ELVSS. Gate-on voltages VGH and VEH may be set to voltages higher than the pixel driving voltage ELVDD, and gate-off voltages VGL and VEL may be set to voltages lower than the low-potential power supply voltage ELVSS. The first and second initialization voltages Vinit1 and Vinit2 may be set to the same or different voltages from each other.

The light-emitting element EL may include an anode electrode connected to a fifth node n5, a cathode electrode to which the low-potential power supply voltage ELVSS is applied, and an organic compound layer connected between the electrodes. The driving element DT includes a first electrode connected to a first node n1, a gate electrode connected to a second node n2, and a second electrode connected to a third node n3.

The first capacitor Csup is connected between the second node n2 and a fourth node n4. The second capacitor Cst is connected between the second node n2 and the third node n3. The first and second capacitors Csup and Cst are connected in parallel to the second node n2.

First and second scan pulses [SCAN(n−1), SCAN(n)] are generated as pulses of the gate-on voltage VGH, and have the same pulse width as each other. The first scan pulse [SCAN(n−1)] is generated in an initialization step Ti prior to the second scan pulse [SCAN(n)]. The second scan pulse [SCAN(n)] is synchronized with the data voltage Vdata.

A third scan pulse [SCAN2H(n)] is generated as a pulse of the gate-on voltage VGH in the initialization step Ti and the sensing step Ts, and has a pulse width longer than the pulse width of each of the first and second scan pulses [SCAN(n−1), SCAN(n)]. When the pulse width of each of the first and second scan pulses [SCAN(n−1), SCAN(n)] is one horizontal period, the pulse width of the third scan pulse [SCAN2H(n)] may be set to two horizontal periods 2H.

The second scan pulse [SCAN(n)] and the third scan pulse [SCAN2H(n)] control the time at which pixel data are written onto the pixel circuit and the threshold voltage sensing time of the driving element using the diode connection circuit to be different. Thereby, the threshold voltage sensing time of the driving element DT may be secured longer to be two horizontal periods 2H.

The first and second EM pulses EM1 and EM2 are inverted to the gate-on voltage VEH in a light emission step Tem, and forms a current path between the pixel driving voltage ELVDD and the light-emitting element EL in at least some section of the light emission step Tem. The pulse widths of the first and second EM pulses EM1 and EM2 may be set to be greater than those of the first and second scan pulses [SCAN(n−1), SCAN(n)] and to be equal to that of the third scan pulse [SCAN2H(n)]. For example, when the pulse width of the scan pulses [SCAN(n−1), SCAN(n)] is one horizontal period, the pulse widths of the first and second EM pulses EM1 and EM2 may be two horizontal periods.

The first EM pulse EM1 is a pulse later in phase than the second EM pulse EM2 and is generated as the gate-off voltage VEL in the sensing step Ts. The first EM pulse EM1 may maintain the gate-off voltage VEL for about one horizontal period at the beginning of the light emission step Tem, but is not limited thereto. The second EM pulse EM2 is generated as the gate-off voltage VEL in the initialization step Ti and the sensing step Ts. The first EM pulse EM1 may be set to be 90° later in phase than the second EM pulse EM2, and thus, overlap the second EM pulse EM2 for about one horizontal period.

The first switch element M31 includes a first electrode connected to the fourth node n4, a second electrode connected to the first node n1, and a gate electrode to which the third scan pulse [SCAN2H(n)] is applied. The first switch element M31 is turned on according to the gate-on voltage VGH of the third scan pulse [SCAN2H(n)], and connects the first node n1 and the fourth node n4 in the initialization step Ti and the sensing step Ts, thereby connecting the electrodes of the driving element DT in an indirect diode connection structure. During the two horizontal periods 2H in which the first switch element M31 is turned on, the threshold voltage Vth of the driving element DT is sensed and stored in the second capacitor Cst.

The second switch element M32 includes a first electrode to which the second initialization voltage Vinit2 is applied, a second electrode connected to the second node n2, and a gate electrode to which the first scan pulse [SCAN(n−1)] is applied. The second switch element M32 is turned on according to the gate-on voltage VGH of the first scan pulse [SCAN(n−1)], and thereby supplies the second initialization voltage Vinit2 to the second node n2 in the initialization step Ti.

The third switch element M33 includes a first electrode to which the first initialization voltage Vinit1 is applied, a second electrode connected to the fifth node n5, and a gate electrode to which the first scan pulse [SCAN(n−1)] is applied. The third switch element M33 is turned on according to the gate-on voltage VGH of the first scan pulse [SCAN(n−1)], and thereby supplies the first initialization voltage Vinit1 to the fifth node n5 in the initialization step Ti.

The fourth switch element M34 includes a first electrode connected to the third node n3, a second electrode to which the data voltage Vdata is applied, and a gate electrode to which the second scan pulse [SCAN(n)] is applied. The fourth switch element M34 is turned on according to the gate-on voltage VGH of the second scan pulse [SCAN(n)], and thereby supplies the data voltage Vdata to the third node n3 in the sensing step Ts.

The fifth switch element M35 includes a first electrode to which the pixel driving voltage ELVDD is applied, a second electrode connected to the first node n1, and a gate electrode to which the first EM pulse EM1 is applied. The fifth switch element M35 is turned off in the sensing step Ts according to the gate-off voltage VEL of the first EM pulse EM1. The voltage of the gate line to which the first EM pulse EM1 is applied is the gate-on voltage VEH in at least some section of the light emission step Tem. Accordingly, the fifth switch element M35 is turned on in at least some section of the light emission step Tem, and forms a current path between the pixel driving voltage ELVDD and the driving element DT.

The sixth switch element M36 includes a first electrode connected to the third node n3, a second electrode connected to the fifth node n5, and a gate electrode to which the second EM pulse EM2 is applied. The sixth switch element M36 is turned off in the initialization step Ti and at least some section of the sensing step Ts, and is turned on in the latter half of the sensing step Ts and the light emission step Tem. The sixth switch element M36 is turned on in at least some section of the light emission step Tem, and forms a current path between the driving element DT and the light-emitting element EL.

Figure 13A:
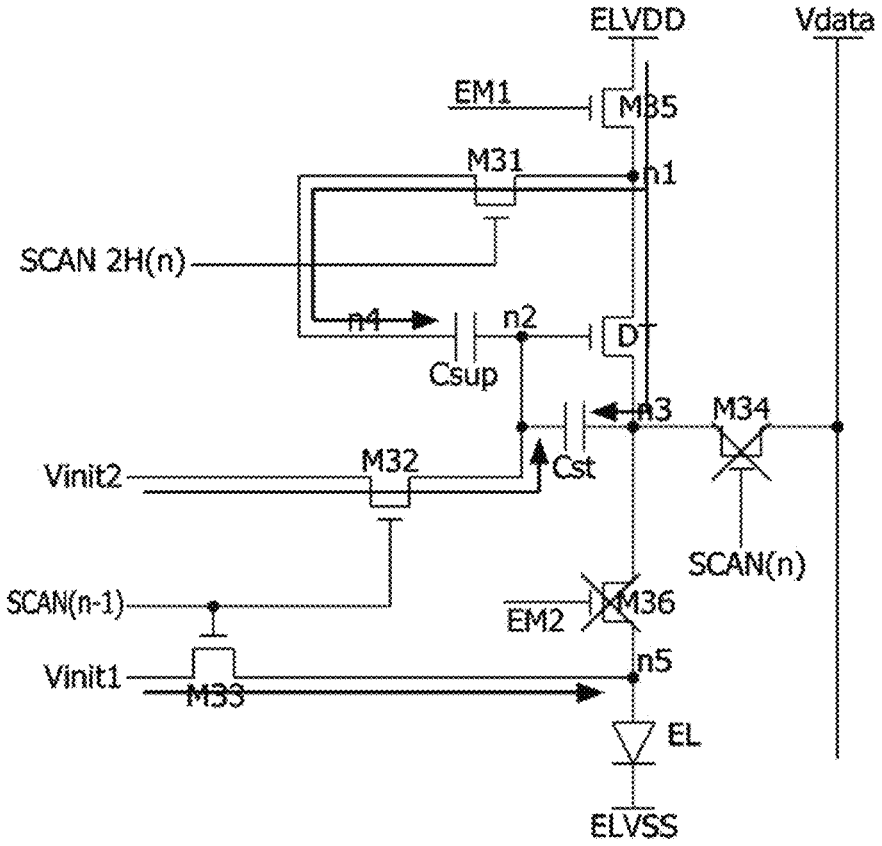
FIG. 13A is a circuit diagram showing switch elements that are turned on/off and a current flow therethrough in an initialization step of the pixel circuit shown in FIG. 11.

In the initialization step Ti, the voltages of the first scan pulse [SCAN(n−1)], the third scan pulse [SCAN2H(n)], and the first EM pulse EM1 are the gate-on voltage VGH. At this time, the second scan pulse [SCAN(n)] and the second EM pulse EM2 are at the gate-off voltages VGL and VEL. In the initialization step Ti, as shown in FIG. 13A, the first, second, and third switch elements M31, M32, and M33 are turned on, so that the fourth node n4 is charged to the pixel driving voltage EVDD, and the second node n2 is charged to the second initialization voltage Vinit2 lower than the pixel driving voltage ELVDD. In the initialization step Ti, the threshold voltage of the driving element DT is sensed in a diode connection method by the first switch element M31 that is turned on. The fifth node n5 is initialized to the first initialization voltage Vinit1 in the initialization step Ti.

Figure 13B:
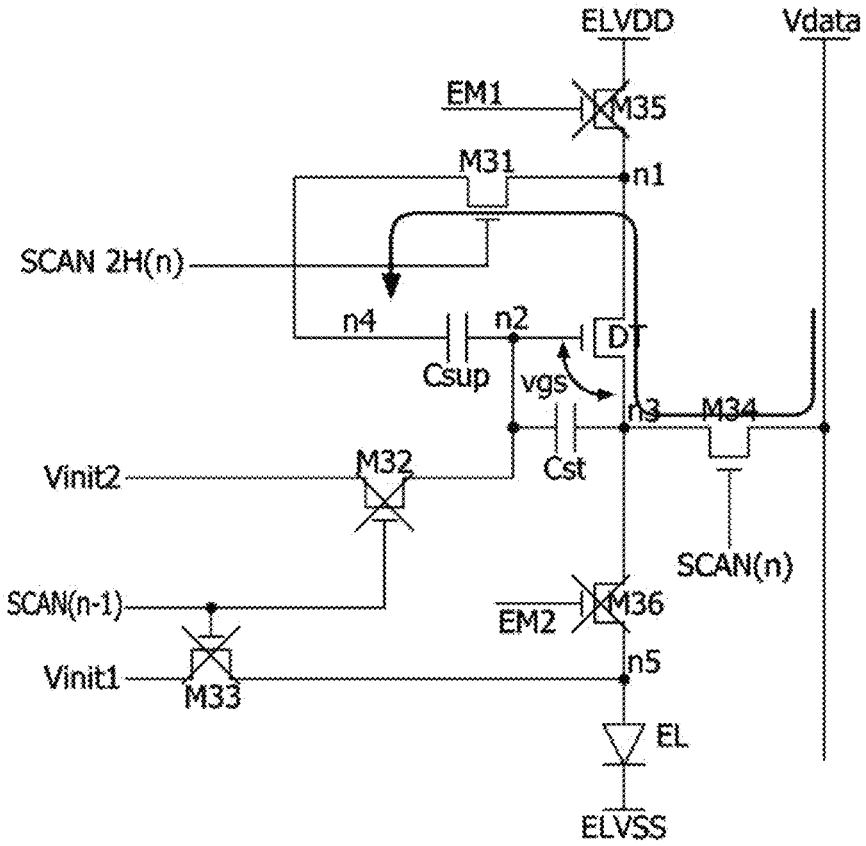
FIG. 13B is a circuit diagram showing switch elements that are turned on/off and a current flow therethrough in a sensing step of the pixel circuit shown in FIG. 11.

In the sensing step Ts, the second scan pulse [SCAN(n)] synchronized with the data voltage Vdata is generated at the gate-on voltage VGH, and the third scan pulse [SCAN2H (n)] maintains the gate-on voltage VGH. In the sensing step Ts, the voltages of the first scan pulse [SCAN(n−1)] and the first and second EM pulses EM1 and EM2 are the gate-off voltages VGL and VEL. The data voltage Vdata is applied to the pixel circuit through the data line and the fourth switch element M34 in the sensing step. In the sensing step Ts, as shown in FIG. 13B, the first switch element M31 is maintained at the on state, and thus, the threshold voltage Vth of the driving element DT is sensed. In the sensing step Ts, when the difference between the voltages DRG' and DRS of the second node n2 and the third node n3 reaches the threshold voltage Vth of the driving element DT, the driving element DT is turned off and the threshold voltage Vth of the driving element DT is stored in the second capacitor Cst. The threshold voltage Vth of the driving element DT can be sensed even if the gate-source voltage Vgs of the driving element DT is shifted to a positive voltage or to a negative voltage.

Figure 13C:
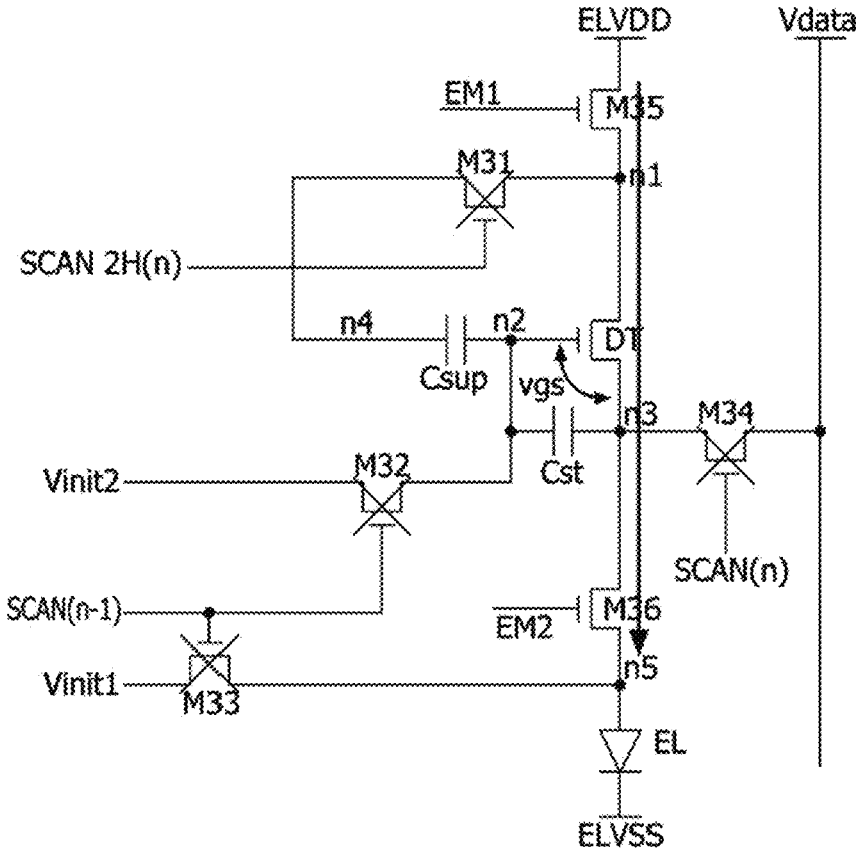
FIG. 13C is a circuit diagram showing switch elements that are turned on/off and a current flow therethrough in a light emission step of the pixel circuit shown in FIG. 11.

In the light emission step Tem, the voltages of the first and second EM pulses EM1 and EM2 are the gate-on voltage VEH. The voltages of the scan pulses [SCAN(n−1), SCAN (n), SCAN2H(n)] are the gate-off voltage VGL in the light emission step Tem. In the light emission step Tem, as shown in FIG. 13C, the fifth and sixth switch elements M35 and M36 are turned on, whereas the other switch elements M31 to M34 are turned off. In the light emission step Tem, a current is supplied to the light-emitting element EL according to the gate-source voltage Vgs of the driving element DT stored in the second capacitor Cst. In the light emission step Tem, the light-emitting element EL emits light at a target luminance corresponding to the gray scale of the pixel data by the current supplied through the driving element DT.

The first and second capacitors Csup and Cst may be implemented with two metal layers facing each other with an insulating layer interposed therebetween in FIG. 16 as viewed from the cross-sectional structure of the display panel 100.

Figure 14:
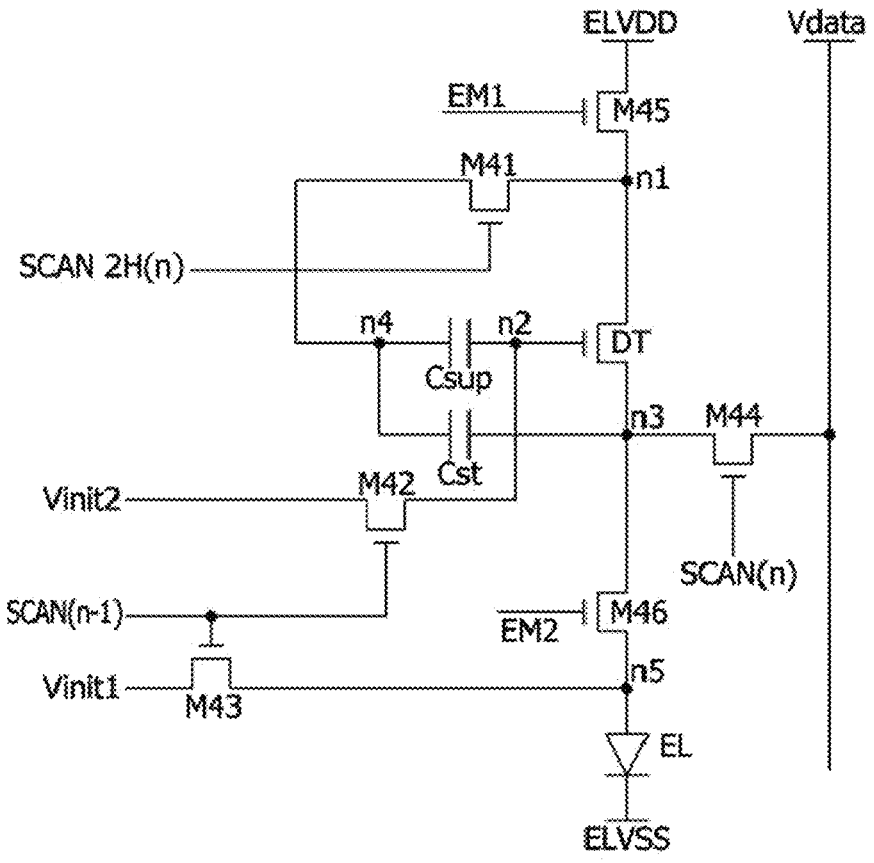
FIG. 14 is a circuit diagram showing a pixel circuit in accordance with a fifth embodiment of the present disclosure.

FIG. 14 is a circuit diagram showing a pixel circuit in accordance with a fifth embodiment of the present disclosure. Gate signals of the pixel circuit shown in FIG. 14 are the same as those of FIG. 12.

Referring to FIGS. 12 and 14, the pixel circuit includes a light-emitting element EL, a driving element DT, first to sixth switch elements M41 to M46, a first capacitor Csup, and a second capacitor Cst. The driving element DT and the switch elements M41 to M46 may be implemented with n-channel transistors.

This pixel circuit is connected to gate lines to which gate signals [SCAN(n−1), SCAN(n), SCAN2H(n), EM1, EM2] are applied, and to a data line to which a data voltage Vdata is applied. Further, a first power line to which a pixel driving voltage ELVDD is applied, a second power line to which a first initialization voltage Vinit1 is applied, a third power line to which a second initialization voltage Vinit2 is applied, and a fourth power line to which a low-potential power supply voltage ELVSS is applied are connected to the pixel circuit.

The DC voltages applied to the pixel circuit may be set as ELVDD>Vinit1>Vinit2>ELVSS. Gate-on voltages VGH and VEH may be set to voltages higher than the pixel driving voltage ELVDD, and gate-off voltages VGL and VEL may be set to voltages lower than the low-potential power supply voltage ELVSS. The second initialization voltage Vinit2 may be set to a voltage lower than the first initialization voltage Vinit1 (Vinit1>Vini2). The first and second initialization voltages Vinit1 and Vinit2 may be set to voltages that satisfy the condition of Vinit1>2 (Vinit2−Vth). Here, "Vth" is the threshold voltage of the driving element DT. The second initialization voltage Vinit2 may be set to a voltage that is higher than the threshold voltage Vth of the driving element DT (Vinit2>Vth), or that is higher than the sum (Vdata+Vth) of the data voltage Vdata and the threshold voltage Vth of the driving element DT (Vinit2>Vdata+Vth).

The light-emitting element EL may include an anode electrode connected to a fifth node n5, a cathode electrode to which the low-potential power supply voltage ELVSS is applied, and an organic compound layer connected between the electrodes. The driving element DT includes a first electrode connected to a first node n1, a gate electrode connected to a second node n2, and a second electrode connected to a third node n3.

The first capacitor Csup is connected between the second node n2 and a fourth node n4. The second capacitor Cst is connected between the fourth node n4 and the third node n3. The first and second capacitors Csup and Cst are connected in series between the second node n2 and the third node n3.

Since the scan pulses [SCAN(n−1), SCAN(n), SCAN2H(n)] and the EM pulses EM1 and EM2 are substantially the same as those in FIG. 12, a detailed description thereof will be omitted. As the switch elements M41 to M46 are substantially the same as the switch elements shown in FIG. 11, a detailed description thereof will be omitted.

Figure 15A:
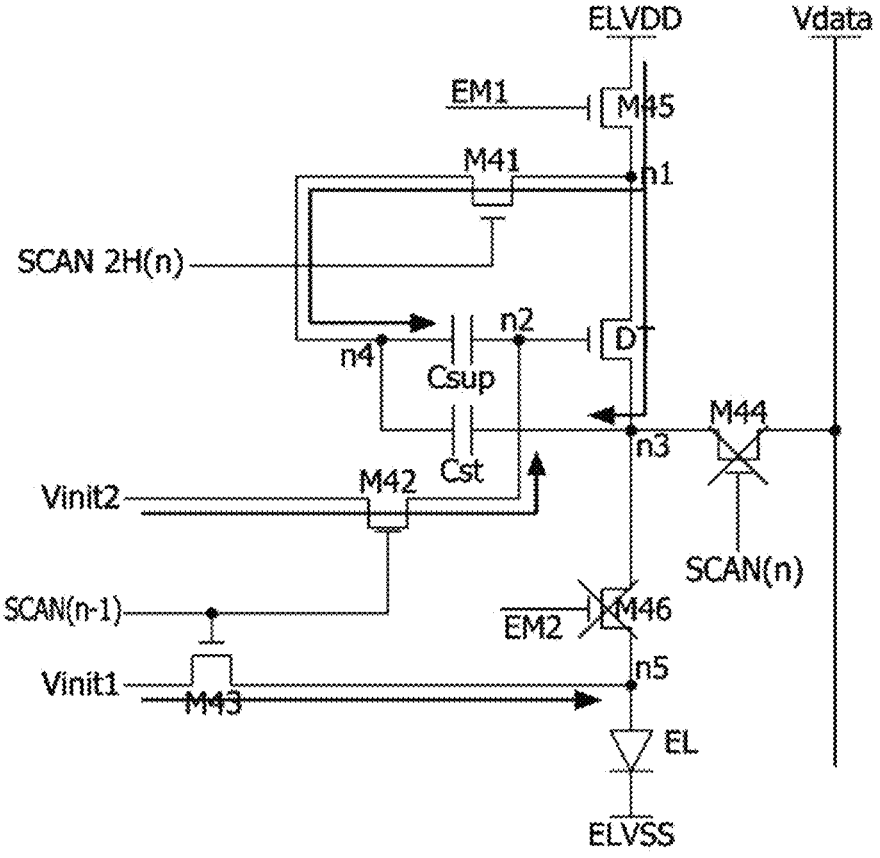
FIG. 15A is a circuit diagram showing switch elements that are turned on/off and a current flow therethrough in an initialization step of the pixel circuit shown in FIG. 14.

In the initialization step Ti, the voltages of the first scan pulse [SCAN(n−1)], the third scan pulse [SCAN2H(n)], and the first EM pulse EM1 are the gate-on voltage VGH. At this time, the second scan pulse [SCAN(n)] and the second EM pulse EM2 are at the gate-off voltages VGL and VEL. In the initialization step Ti, as shown in FIG. 15A, the first, second, and third switch elements M41, M42, and M43 are turned on, so that the fourth node n4 is charged to the pixel driving voltage EVDD, and the second node n2 is charged to the second initialization voltage Vinit2 lower than the pixel driving voltage ELVDD. In the initialization step Ti, the threshold voltage of the driving element DT is sensed in a diode connection method by the first switch element M41 that is turned on. The fifth node n5 is initialized to the first initialization voltage Vinit1 in the initialization step Ti.

Figure 15B:
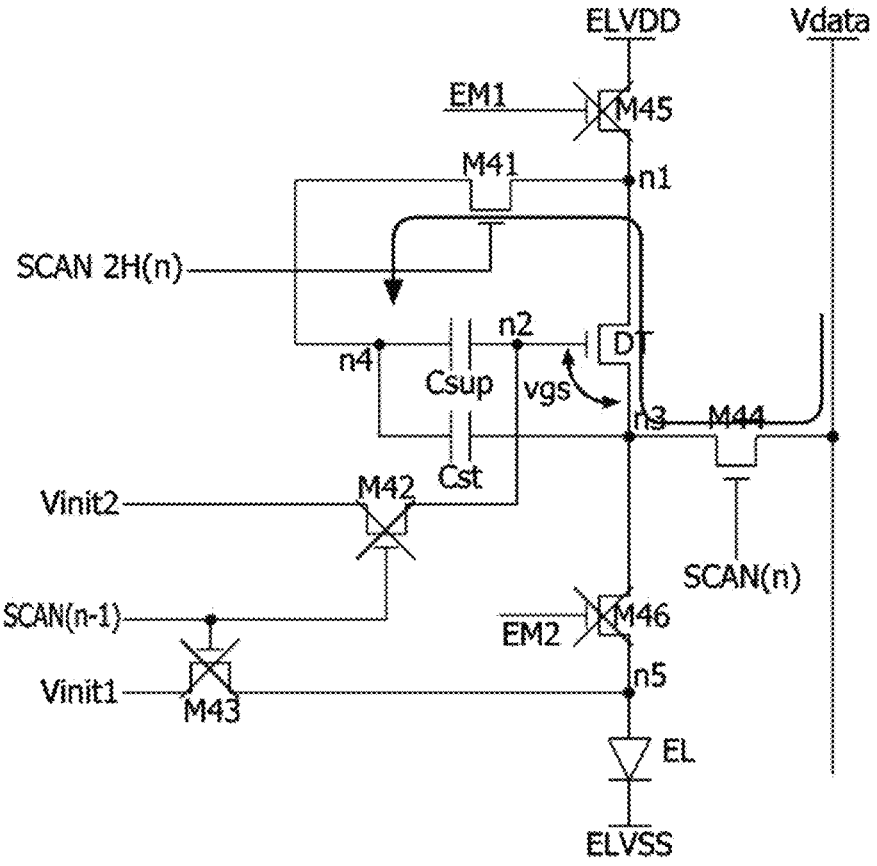
FIG. 15B is a circuit diagram showing switch elements that are turned on/off and a current flow therethrough in a sensing step of the pixel circuit shown in FIG. 14.

In the sensing step Ts, the second scan pulse [SCAN(n)] synchronized with the data voltage Vdata is generated at the gate-on voltage VGH, and the third scan pulse [SCAN2H(n)] maintains the gate-on voltage VGH. In the sensing step Ts, the voltages of the first scan pulse [SCAN(n−1)] and the first and second EM pulses EM1 and EM2 are the gate-off voltages VGL and VEL. The data voltage Vdata is applied to the pixel circuit through the data line and the fourth switch element M44 in the sensing step. In the sensing step Ts, as shown in FIG. 15B, the first switch element M41 is maintained at the on state, and thus, the threshold voltage Vth of the driving element DT is sensed. In the sensing step Ts, when the difference between the voltages DRG' and DRS of the second node n2 and the third node n3 reaches the threshold voltage Vth of the driving element DT, the driving element DT is turned off and the threshold voltage Vth of the driving element DT is stored in the second capacitor Cst. The threshold voltage Vth of the driving element DT can be sensed even if the gate-source voltage Vgs of the driving element DT is shifted to a positive voltage or to a negative voltage.

Figure 15C:
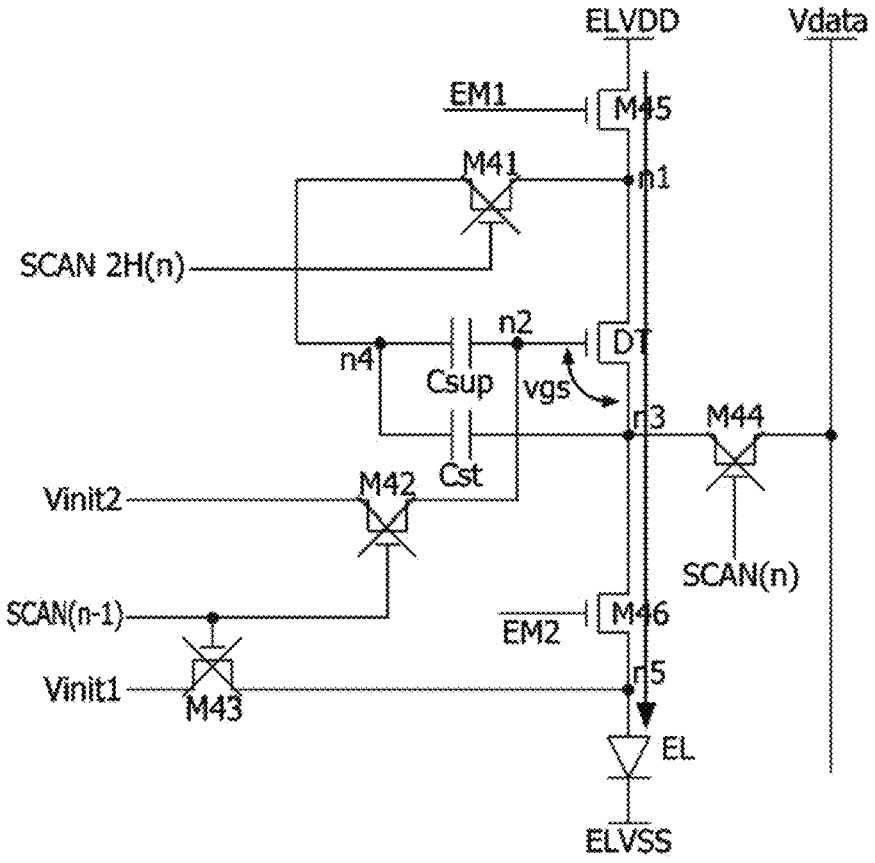
FIG. 15C is a circuit diagram showing switch elements that are turned on/off and a current flow therethrough in a light emission step of the pixel circuit shown in FIG. 14.

In the light emission step Tem, the voltages of the first and second EM pulses EM1 and EM2 are the gate-on voltage VEH. The voltages of the scan pulses [SCAN(n−1), SCAN(n), SCAN2H(n)] are the gate-off voltage VGL in the light emission step Tem. In the light emission step Tem, as shown in FIG. 15C, the fifth and sixth switch elements M45 and M46 are turned on, whereas the other switch elements M41 to M44 are turned off. In the light emission step Tem, a current is supplied to the light-emitting element EL according to the gate-source voltage Vgs of the driving element DT stored in the second capacitor Cst. In the light emission step Tem, the light-emitting element EL emits light at a target luminance corresponding to the gray scale of the pixel data by the current supplied through the driving element DT.

The first and second capacitors Csup and Cst may be implemented with two metal layers facing each other with an insulating layer interposed therebetween in FIG. 16 as viewed from the cross-sectional structure of the display panel 100.

FIG. 16 is a cross-sectional view showing capacitors of a pixel circuit in a cross-sectional structure of a display panel 100 in accordance with one embodiment of the present disclosure. It should be noted that the cross-sectional structure of the display panel 100 is not limited to FIG. 16.

Referring to FIG. 16, a circuit layer 12 may include a first metal layer LS, a first insulating layer BUF, an active layer ACT, a second insulating layer GI, a second metal layer GATE, a third insulating layer ILD, a third metal layer SD1, a fourth insulating layer PAC1, a fourth metal layer SD2, and a fifth insulating layer PAC2.

The first metal layer LS may include a bottom shield pattern disposed under a driving element DT. The bottom shield pattern blocks external light so that the semiconductor pattern of the driving element is not irradiated with light.

The metal patterns of the first metal layer are covered with the first insulating layer BUF.

The first insulating layer BUF may be formed of an inorganic insulating material and consist of a structure in which one or more insulating layers are stacked. The active layer ACT is formed of a semiconductor material that is vapor-deposited on the first insulating layer BUF.

The active layer ACT includes a semiconductor pattern of each of the transistors in the pixel circuit. The active layer ACT may be metalized in its portion by ion doping. The metalized active layer may be used as a jumper pattern connecting metal layers at some nodes in the pixel circuit.

The second insulating layer GI may be an inorganic insulating film formed on the first insulating layer BUF so as to cover the active layer ACT. The second metal layer GATE is formed on the second insulating layer GI. The second metal layer GATE may include gate lines and gate electrode patterns of transistors.

The third insulating layer ILD includes an inorganic insulating film that covers the metal patterns of the second metal layer GATE, and is formed on the second insulating layer GI. The third metal layer SD1 is formed on the third insulating layer ILD. The fourth insulating layer PAC1 includes an organic insulating film that covers the metal patterns of the third metal layer SD1. The fourth metal layer SD2 is formed on the fourth insulating layer PAC1. First and second electrode patterns of the transistor and power lines may be formed on the third metal layer SD1 and the fourth metal layer SD2.

The fifth insulating layer PAC2 includes an organic insulating film that covers the metal patterns of the fourth metal layer SD2, and flattens the surface of the circuit layer 12. The anode electrode ANO of a light-emitting element EL is formed on the fifth insulating layer PAC2.

The bank pattern BNK of a light-emitting element layer 14 exposes the anode electrode ANO in each of the subpixels and defines a light-emitting region of a subpixel. An organic compound layer of the light-emitting element EL and a cathode electrode CAT cover the bank pattern BNK and the anode electrode ANO. A multi-insulating film ENC of an encapsulation layer 16 covers the cathode electrode CAT and flattens the surface of the encapsulation layer 16.

A first capacitor Csup may be formed at a portion where the metal pattern of the third metal layer SD1 and the metal pattern of the second metal layer GATE overlap. A second capacitor Cst may be formed at a portion where the metal pattern of the second metal layer GATE and the metal pattern of the first metal layer LS overlap. The first and second capacitors Csup and Cst may be implemented to be the same or similar in their size.

Figure 17:
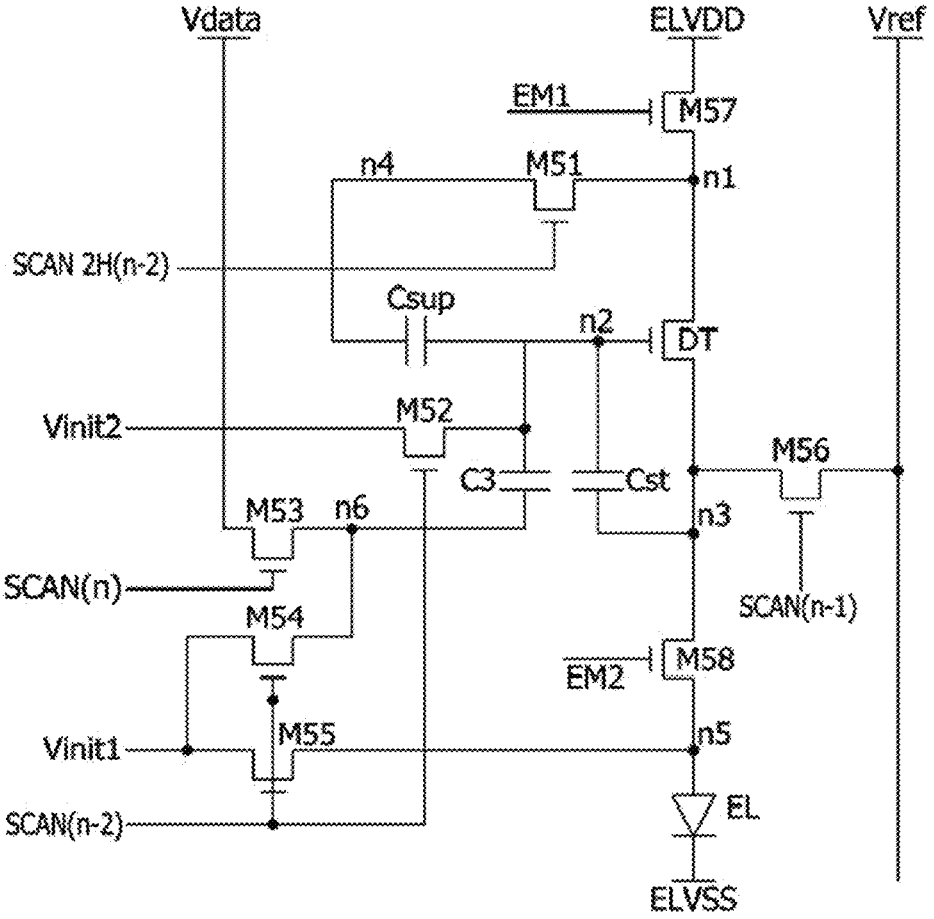
FIG. 17 is a circuit diagram showing a pixel circuit in accordance with a sixth embodiment of the present disclosure.
Figure 18:
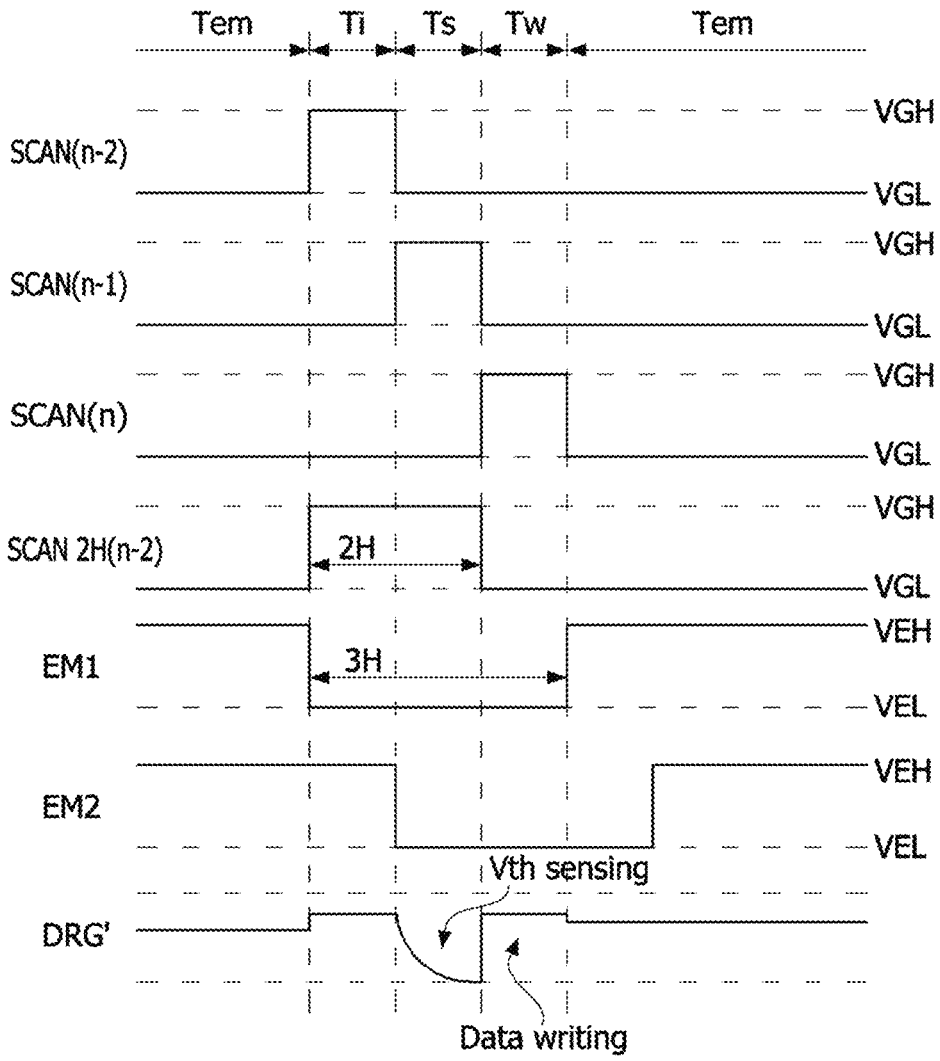
FIG. 18 is a waveform diagram showing gate signals applied to the pixel circuit shown in FIG. 17 and gate voltages of a driving element.

FIG. 17 is a circuit diagram showing a pixel circuit in accordance with a sixth embodiment of the present disclosure. FIG. 18 is a waveform diagram showing gate signals applied to the pixel circuit shown in FIG. 17 and gate voltages of a driving element.

Referring to FIGS. 17 and 18, the pixel circuit includes a light-emitting element EL, a driving element DT, first to eighth switch elements M51 to M58, a first capacitor Csup, a second capacitor Cst, and a third capacitor C3. The driving element DT and the switch elements M51 to M58 may be implemented with re-channel transistors.

This pixel circuit is connected to gate lines to which gate signals [SCAN2H(n−2), SCAN(n−2), SCAN(n−1), SCAN(n), EM1, EM2] are applied, and to a data line to which a data voltage Vdata is applied. Further, a first power line to which a pixel driving voltage ELVDD is applied, a second power line to which a first initialization voltage Vinit1 is applied, a third power line to which a second initialization voltage Vinit2 is applied, a fourth power line to which a reference voltage Vref is applied, and a fifth power line to which a low-potential power supply voltage ELVSS is applied are connected to the pixel circuit.

A first scan pulse [SCAN2H(n−2)] rises simultaneously with a second scan pulse [SCAN(n−2)], and thereby maintains a gate-on voltage VGH in an initialization step Ti and a sensing step Ts. The first scan pulse [SCAN2H(n−2)] has a pulse width of two horizontal periods 2H, and overlaps the second scan pulse [SCAN(n−2)] and a third scan pulse [SCAN(n−1)] in the initialization step Ti and the sensing step Ts.

The second scan pulse [SCAN(n−2)] is generated as the gate-on voltage VGH in the initialization step Ti. The third scan pulse [SCAN(n−1)] is generated as the gate-on voltage VGH in the sensing step Ts. A fourth scan pulse [SCAN(n)] is generated as the gate-on voltage VGH in a data writing step Tw. The second to fourth scan pulses [SCAN(n−2), SCAN(n−1), SCAN(n)] each have a pulse width of one horizontal period, and are sequentially shifted in phase.

A first EM pulse EM1 is generated as a gate-off voltage VEL in the initialization step Ti, the sensing step Ts, and the data writing step Tw. A second EM pulse EM2 is generated as a pulse later in phase than the first EM pulse EM1, and rises approximately one horizontal period after the first EM pulse EM1 rises. The second EM pulse EM2 is generated as the gate-off voltage VEL in the sensing step Ts and the data writing step Tw. The second EM pulse EM2 may maintain the gate-off voltage VEL for about one horizontal period at the beginning of the light emission step Tem, but is not limited thereto. The first to second EM pulses EM1 and EM2 may have the same pulse width, for example, a pulse width of three (3) horizontal periods 3H. The second EM pulse EM2 may overlap the first EM pulse EM1 by two horizontal periods 2H.

The reference voltage Vref and the first and second initialization voltages Vinit1 and Vinit2 may be set to voltages that are lower than the pixel driving voltage ELVDD and are higher than the low-potential power supply voltage ELVSS. The gate-on voltages VGH and VEH may be set to voltages higher than the pixel driving voltage ELVDD, and the gate-off voltages VGL and VEL may be set to voltages lower than the low-potential power supply voltage ELVSS.

The light-emitting element EL may include an anode electrode connected to a fifth node n5, a cathode electrode to which the low-potential power supply voltage ELVSS is applied, and an organic compound layer connected between the electrodes. The driving element DT includes a first electrode connected to a first node n1, a gate electrode connected to a second node n2, and a second electrode connected to a third node n3.

The first capacitor Csup is connected between the second node n2 and a fourth node n4. The second capacitor Cst is connected between the second node n2 and the third node n3. The third capacitor C3 is connected between the second node n2 and a sixth node n6. Although the third capacitor C3 is omitted from FIG. 16, the capacitors Csup, Cst, and C3 may be implemented with two metal layers facing each other with an insulating layer interposed therebetween in FIG. 16.

The first switch element M51 includes a first electrode connected to the fourth node n4, a second electrode connected to the first node n1, and a gate electrode to which the first scan pulse [SCAN2H(n−2)] is applied. The first switch element M51 is turned on according to the gate-on voltage VGH of the first scan pulse [SCAN2H(n−2)], and connects the first node n1 and the fourth node n4 in the initialization step Ti and the sensing step Ts, thereby connecting the electrodes of the driving element DT in an indirect diode connection structure.

The second switch element M52 includes a first electrode to which the second initialization voltage Vinit2 is applied, a second electrode connected to the second node n2, and a gate electrode to which the second scan pulse [SCAN(n−2)] is applied. The second switch element M52 is turned on according to the gate-on voltage VGH of the second scan pulse [SCAN(n−2)], and thereby supplies the second initialization voltage Vinit2 to the second node n2 in the initialization step Ti.

The third switch element M53 includes a first electrode connected to a data line to which the data voltage Vdata is applied, a second electrode connected to the sixth node n6, and a gate electrode to which the fourth scan pulse [SCAN(n)] is applied. The third switch element M53 is turned on according to the gate-on voltage VGH of the fourth scan pulse [SCAN(n)], and thereby supplies the data voltage Vdata to the sixth node n6 in the data writing step Tw.

The fourth switch element M54 includes a first electrode to which the first initialization voltage Vinit1 is applied, a second electrode connected to the sixth node n6, and a gate electrode to which the second scan pulse [SCAN(n−2)] is applied. The fourth switch element M54 is turned on according to the gate-on voltage VGH of the second scan pulse [SCAN(n−2)], and thereby supplies the first initialization voltage Vinit1 to the sixth node n6 in the initialization step Ti.

The fifth switch element M55 includes a first electrode to which the first initialization voltage Vinit1 is applied, a second electrode connected to the fifth node n5, and a gate electrode to which the second scan pulse [SCAN(n−2)] is applied. The fifth switch element M55 is turned on according to the gate-on voltage VGH of the second scan pulse [SCAN(n−2)], and thereby supplies the first initialization voltage Vinit1 to the fifth node n5 in the initialization step Ti.

The sixth switch element M56 includes a first electrode connected to the third node n3, a second electrode to which the reference voltage Vref is applied, and a gate electrode to which the third scan pulse [SCAN(n−1)] is applied. The sixth switch element M56 is turned on according to the gate-on voltage VGH of the third scan pulse [SCAN(n−1)], and thereby supplies the reference voltage Vref to the third node n3 in the sensing step Ts.

The seventh switch element M57 includes a first electrode to which the pixel driving voltage ELVDD is applied, a second electrode connected to the first node n1, and a gate electrode to which the first EM pulse EM1 is applied. The seventh switch element M57 is turned off in the initialization step Ti, the sensing step Ts, and the data writing step Tw according to the gate-off voltage VEL of the first EM pulse EM1. The voltage of the gate line to which the first EM pulse EM1 is applied is the gate-on voltage VEH in at least some section of the light emission step Tem. Accordingly, the seventh switch element M57 is turned on in at least some section of the light emission step Tem, and forms a current path between the pixel driving voltage ELVDD and the driving element DT.

The eighth switch element M58 includes a first electrode connected to the third node n3, a second electrode connected to the fifth node n5, and a gate electrode to which the second EM pulse EM2 is applied. The eighth switch element M58 is turned off in the sensing step Ts and the data writing step Tw according to the gate-off voltage VEL of the second EM pulse EM2. The voltage of the gate line to which the second EM pulse EM2 is applied is the gate-on voltage VEH in at least some section of the light emission step Tem. Accordingly, the eighth switch element M58 is turned on in at least some section of the light emission step Tem, and forms a current path between the driving element DT and the light-emitting element EL.

Figure 19A:
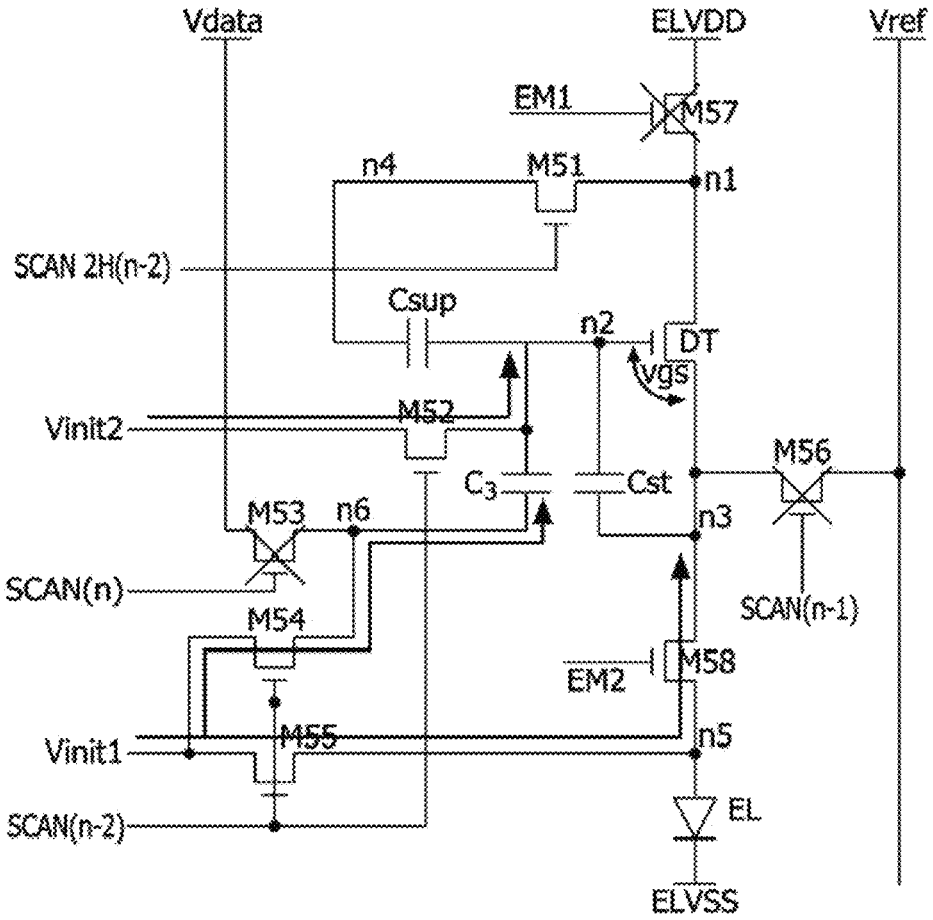
FIG. 19A is a circuit diagram showing switch elements that are turned on/off and a current flow therethrough in an initialization step of the pixel circuit shown in FIG. 17.

In the initialization step Ti, the first scan pulse [SCAN2H(n−2)], the second scan pulse [SCAN(n−2)], and the second EM pulse EM2 are generated as the gate-on voltages VGH and VEH. At this time, the third scan pulse [SCAN(n−1)], the fourth scan pulse [SCAN(n)], and the first EM pulse EM1 are at the gate-off voltages VGL and VEL. In the initialization step Ti, as shown in FIG. 19A, the first, second, fourth, fifth, and eighth switch elements M51, M52, M54, M55 and M58 are turned on, and thus, the first initialization voltage Vinit1 is applied to the third, fifth, and sixth nodes n3, n5, and n6, and the pixel driving voltage ELVDD is applied to the fourth node n4, thereby initializing the capacitors Csup, Cst, and C3. At this time, the voltage DRG' of the second node n2 becomes lower than the voltage DRG of the fourth node n4. In the initialization step Ti, the driving element DT is turned on as the gate-source voltage Vgs is set to the threshold voltage Vth or higher.

Figure 19B:
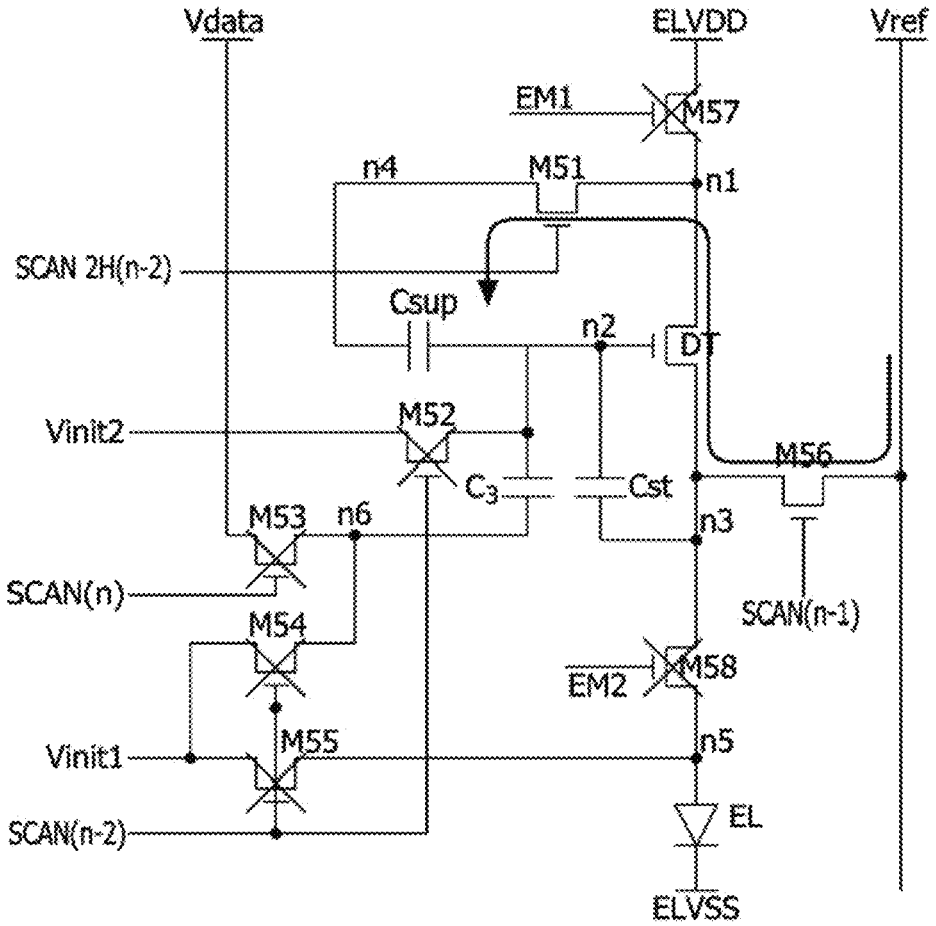
FIG. 19B is a circuit diagram showing switch elements that are turned on/off and a current flow therethrough in a sensing step of the pixel circuit shown in FIG. 17.

In the sensing step Ts, the first scan pulse [SCAN2H(n−2)] and the third scan pulse [SCAN(n−1)] are generated as the gate-on voltage VGH. At this time, the voltages of the second scan pulse [SCAN(n−2)], the fourth scan pulse [SCAN(n)], the first EM pulse EM1, and the second EM pulse EM2 are the gate-off voltages VGL and VEL. In the sensing step Ts, as shown in FIG. 19B, the first and sixth switch elements M51 and M56 are turned on, and thus, the reference voltage Vref is applied to the third node n3, the driving element DT, the first node n1, and the fourth node n4. In the sensing step Ts, when the difference between the voltages DRG' and DRS of the second node n2 and the third node n3 reaches the threshold voltage Vth of the driving element DT, the driving element DT is turned off and the threshold voltage Vth of the driving element DT is stored in the second capacitor Cst. The threshold voltage Vth of the driving element DT can be sensed even if the gate-source voltage Vgs of the driving element DT is shifted to a positive voltage or to a negative voltage.

Figure 19C:
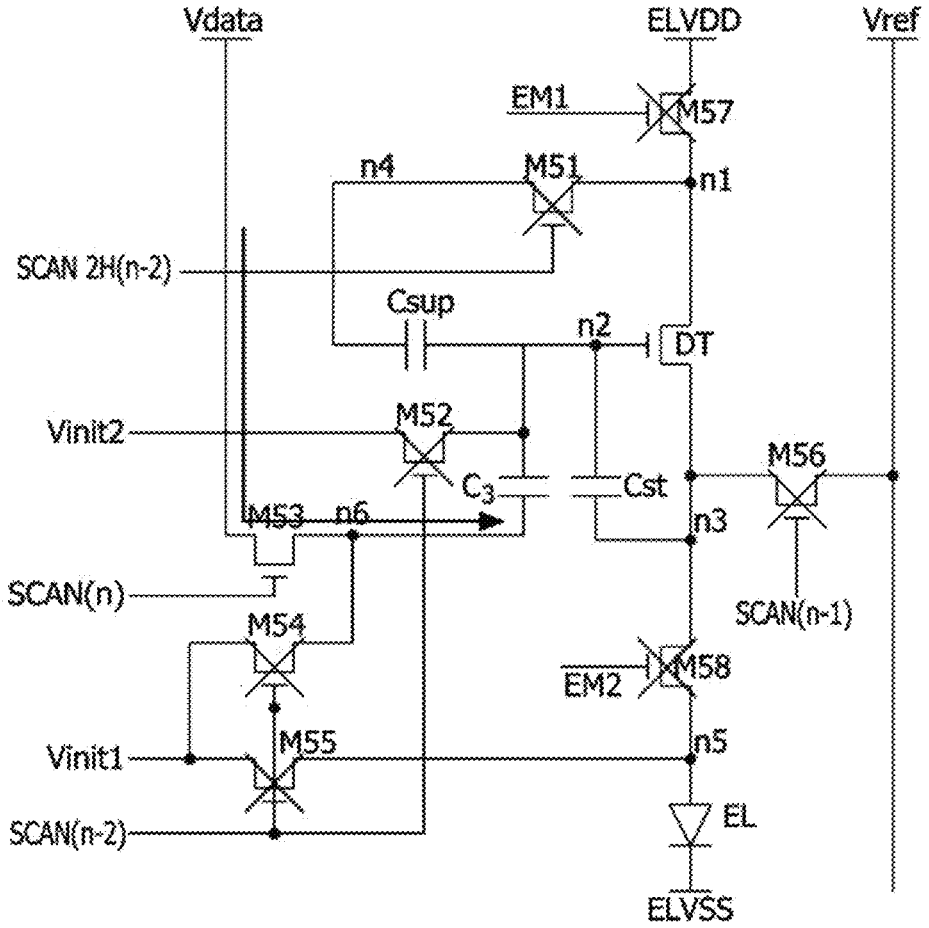
FIG. 19C is a circuit diagram showing switch elements that are turned on/off and a current flow therethrough in a data writing step of the pixel circuit shown in FIG. 17.

In the data writing step Tw, the fourth scan pulse [SCAN(n)] synchronized with the data voltage Vdata is generated as the gate-on voltage VGH, and the other gate signals [SCAN2H(n−2), SCAN(n−2), SCAN(n−1), EM1, EM2] are at the gate-off voltages VGL and VEL. At this time, as shown in FIG. 19C, the third switch element M53 is turned on, and the data voltage is transmitted to the second node n2 through the third capacitor C3. Because the threshold voltage Vth stored in the second capacitor Cst is erased if the third switch element M53 is directly connected to the second node n2 without the third capacitor C3, the data voltage Vdata needs be transmitted to the second node n2 through capacitor coupling. In the data writing step Tw, the voltage of the second node n2 changes to Vdata+Vth, and the voltage of the third node n3 is the reference voltage Vref.

Figure 19D:
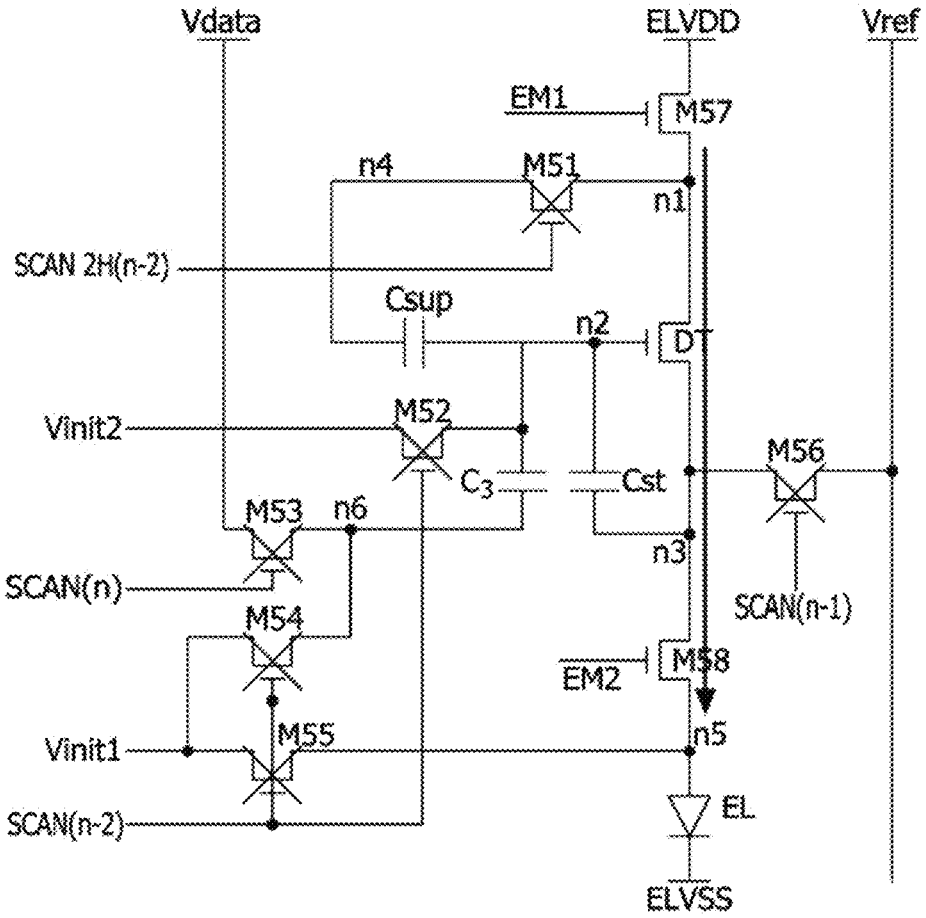
FIG. 19D is a circuit diagram showing switch elements that are turned on/off and a current flow therethrough in a light emission step of the pixel circuit shown in FIG. 17.

In the light emission step Tem, the first and second EM pulses EM1 and EM2 are inverted to the gate-on voltage VEH. The scan pulses [SCAN2H(n−2), SCAN(n−2), SCAN(n−1), and SCAN(n)] are at the gate-off voltage VGL in the light emission step Tem. In the light emission step Tem, as shown in FIG. 19D, the seventh and eighth switch elements M57 and M58 are turned on, whereas the other switch elements M51 to M56 are turned off. In the light emission step Tem, a current is supplied to the light-emitting element EL according to the gate-source voltage Vgs of the driving element DT stored in the second capacitor Cst.

The objects to be achieved by the present disclosure, the means for achieving the objects, and effects of the present disclosure described above do not specify essential features of the claims, and thus, the scope of the claims is not limited to the specific description of the present disclosure.

It will be apparent to those skilled in the art that various modifications and variations can be made in the pixel circuit and the display device including the same of the present disclosure without departing from the technical idea or scope of the disclosure. Thus, it is intended that the present disclosure cover the modifications and variations of this disclosure provided they come within the scope of the appended claims and their equivalents.

What is claimed is:

1. A pixel circuit comprising:

a driving element comprising a first electrode connected to a first node, a gate electrode connected to a second node, and a second electrode connected to a third node;

a first switch element comprising a first electrode connected to a fourth node, a gate electrode to which a scan pulse is applied, and a second electrode connected to the first node, and configured to be turned on according to a gate-on voltage of the scan pulse while a threshold voltage of the driving element is sensed; and a first capacitor connected between the second node and the fourth node.

2. The pixel circuit of claim 1, wherein in a sensing step in which the threshold voltage of the driving element is sensed and an initialization step prior to the sensing step, a voltage of the fourth node is higher than a voltage of the second node.

3. The pixel circuit of claim 2, further comprising:

a second capacitor connected between the second node and the third node.

4. The pixel circuit of claim 3, comprising:

a light-emitting element comprising an anode electrode connected to a fifth node and a cathode electrode to which a low-potential power supply voltage is applied;

a second switch element comprising a first electrode connected to the fourth node, a second electrode to which a first initialization voltage is applied, and a gate electrode to which a first scan pulse is applied, and configured to be turned on according to a gate-on voltage of the first scan pulse in the initialization step;

a third switch element comprising a first electrode to which a second initialization voltage lower than the first initialization voltage is applied, a second electrode connected to the second node, and a gate electrode to which the first scan pulse is applied, and configured to be turned on according to the gate-on voltage of the first scan pulse in the initialization step;

a fourth switch element comprising a first electrode to which the first initialization voltage is applied, a second electrode connected to the fifth node, and a gate electrode to which the first scan pulse is applied, and configured to be turned on according to the gate-on voltage of the first scan pulse in the initialization step;

a fifth switch element comprising a first electrode connected to the third node, a second electrode to which a data voltage is applied, and a gate electrode to which a second scan pulse generated subsequent to the first scan pulse is applied, and configured to be turned on according to a gate-on voltage of the second scan pulse in the sensing step;

a sixth switch element comprising a first electrode to which a pixel driving voltage is applied, a second electrode connected to the first node, and a gate electrode to which an emission control pulse is applied, and configured to be turned on according to a gate-on voltage of the emission control pulse in a light emission step after the sensing step; and a seventh switch element comprising a first electrode connected to the third node, a second electrode connected to the fifth node, and a gate electrode to which the emission control pulse is applied, and configured to be turned on according to the gate-on voltage of the emission control pulse in the light emission step, wherein the scan pulse applied to the first switch element is the second scan pulse, and the pixel driving voltage is higher than the first initialization voltage, and the low-potential power supply voltage is lower than the second initialization voltage.

5. The pixel circuit of claim 4, wherein the second initialization voltage is set to a voltage that is higher than the threshold voltage of the driving element, or that is higher than the sum of the data voltage and the threshold voltage of the driving element.

6. The pixel circuit of claim 2, further comprising:

a second capacitor connected between the third node and the fourth node.

7. The pixel circuit of claim 6, further comprising:

a light-emitting element comprising an anode electrode connected to a fifth node and a cathode electrode to which a low-potential power supply voltage is applied;

a second switch element comprising a first electrode connected to the fourth node, a second electrode to which a first initialization voltage is applied, and a gate electrode to which a first scan pulse is applied, and configured to be turned on according to a gate-on voltage of the first scan pulse in the initialization step;

a third switch element comprising a first electrode to which a second initialization voltage lower than the first initialization voltage is applied, a second electrode connected to the second node, and a gate electrode to which the first scan pulse is applied, and configured to be turned on according to the gate-on voltage of the first scan pulse in the initialization step;

a fourth switch element comprising a first electrode to which the first initialization voltage is applied, a second electrode connected to the fifth node, and a gate electrode to which the first scan pulse is applied, and configured to be turned on according to the gate-on voltage of the first scan pulse in the initialization step;

a fifth switch element comprising a first electrode connected to the third node, a second electrode to which a data voltage is applied, and a gate electrode to which a second scan pulse generated subsequent to the first scan pulse is applied, and configured to be turned on according to a gate-on voltage of the second scan pulse in the sensing step;

a sixth switch element comprising a first electrode to which a pixel driving voltage is applied, a second electrode connected to the first node, and a gate electrode to which an emission control pulse is applied, and configured to be turned on according to a gate-on voltage of the emission control pulse in a light emission step after the sensing step; and a seventh switch element comprising a first electrode connected to the third node, a second electrode connected to the fifth node, and a gate electrode to which the emission control pulse is applied, and configured to be turned on according to the gate-on voltage of the emission control pulse in the light emission step, wherein the scan pulse applied to the first switch element is the second scan pulse, and the pixel driving voltage is higher than the first initialization voltage, and the low-potential power supply voltage is lower than the second initialization voltage.

8. The pixel circuit of claim 7, wherein the second initialization voltage is set to a voltage that is higher than the threshold voltage of the driving element, or that is higher than the sum of the data voltage and the threshold voltage of the driving element.

9. The pixel circuit of claim 1, further comprising:

a second capacitor connected between the second node and the third node, wherein in an initialization step and a sensing step in which the threshold voltage of the driving element is sensed, a voltage of the fourth node is higher than a voltage of the second node.

10. The pixel circuit of claim 9, further comprising:

a light-emitting element comprising an anode electrode connected to a fifth node and a cathode electrode to which a low-potential power supply voltage is applied;

a second switch element comprising a first electrode to which a second initialization voltage is applied, a second electrode connected to the second node, and a gate electrode to which a first scan pulse is applied, and configured to be turned on according to a gate-on voltage of the first scan pulse in the initialization step;

a third switch element comprising a first electrode to which a first initialization voltage is applied, a second electrode connected to the fifth node, and a gate electrode to which the first scan pulse is applied, and configured to be turned on according to the gate-on voltage of the first scan pulse in the initialization step;

a fourth switch element comprising a first electrode connected to the third node, a second electrode to which a data voltage is applied, and a gate electrode to which a second scan pulse generated subsequent to the first scan pulse is applied, and configured to be turned on according to a gate-on voltage of the second scan pulse in the sensing step;

a fifth switch element comprising a first electrode to which a pixel driving voltage is applied, a second electrode connected to the first node, and a gate electrode to which a first emission control pulse is applied, and configured to be turned on according to a gate-on voltage of the first emission control pulse; and a sixth switch element comprising a first electrode connected to the third node, a second electrode connected to the fifth node, and a gate electrode to which a second emission control pulse is applied, and configured to be turned on according to a gate-on voltage of the second emission control pulse, wherein the scan pulse applied to the first switch element is:

a third scan pulse that has a pulse width wider than the pulse width of each of the first and second scan pulses, that is generated as a gate-on voltage in the initialization step and the sensing step, and that is applied to the gate electrode of the first switch element, the first emission control pulse is generated as a gate-off voltage in the sensing step, and is applied as the gate-on voltage to the gate electrode of the fifth switch element in a light emission step after the sensing step, the second emission control pulse is generated as a gate-off voltage in the initialization step and at least some section of the sensing step, and is applied as the gate-on voltage to the gate electrode of the sixth switch element in the light emission step after the sensing step, and the pixel driving voltage is higher than the first and second initialization voltages, and the low-potential power supply voltage is lower than the second initialization voltage.

11. The pixel circuit of claim 10, wherein the first and second scan pulses each have a pulse width of one horizontal period, the third scan pulse, the first emission control pulse, and the second emission control pulse each have a pulse width of two horizontal periods, and the first emission control pulse overlaps the second emission control pulse by the one horizontal period.

12. The pixel circuit of claim 1, further comprising:

a second capacitor connected between the third node and the fourth node, wherein in an initialization step and a sensing step in which the threshold voltage of the driving element is sensed, a voltage of the fourth node is higher than a voltage of the second node.

13. The pixel circuit of claim 12, further comprising:

a light-emitting element comprising an anode electrode connected to a fifth node and a cathode electrode to which a low-potential power supply voltage is applied;

a second switch element comprising a first electrode to which a second initialization voltage is applied, a second electrode connected to the second node, and a gate electrode to which a first scan pulse is applied, and configured to be turned on according to a gate-on voltage of the first scan pulse in the initialization step;

a third switch element comprising a first electrode to which a first initialization voltage is applied, a second electrode connected to the fifth node, and a gate electrode to which the first scan pulse is applied, and configured to be turned on according to the gate-on voltage of the first scan pulse in the initialization step;

a fourth switch element comprising a first electrode connected to the third node, a second electrode to which a data voltage is applied, and a gate electrode to which a second scan pulse generated subsequent to the first scan pulse is applied, and configured to be turned on according to a gate-on voltage of the second scan pulse in the sensing step;

a fifth switch element comprising a first electrode to which a pixel driving voltage is applied, a second electrode connected to the first node, and a gate electrode to which a first emission control pulse is applied, and configured to be turned on according to a gate-on voltage of the first emission control pulse; and a sixth switch element comprising a first electrode connected to the third node, a second electrode connected to the fifth node, and a gate electrode to which a second emission control pulse is applied, and configured to be turned on according to a gate-on voltage of the second emission control pulse, wherein the scan pulse applied to the first switch element is:

a third scan pulse that has a pulse width wider than the pulse width of each of the first and second scan pulses, that is generated as a gate-on voltage in the initialization step and the sensing step, and that is applied to the gate electrode of the first switch element, the first emission control pulse is generated as a gate-off voltage in the sensing step, and is applied as the gate-on voltage to the gate electrode of the fifth switch element in a light emission step after the sensing step, the second emission control pulse is generated as a gate-off voltage in the initialization step and at least some section of the sensing step, and is applied as the gate-on voltage to the gate electrode of the sixth switch element in the light emission step after the sensing step, and the pixel driving voltage is higher than the first and second initialization voltages, and the low-potential power supply voltage is lower than the second initialization voltage.

14. The pixel circuit of claim 13, wherein the first and second scan pulses each have a pulse width of one horizontal period, each of the third scan pulse, the first emission control pulse, and the second emission control pulse have a pulse width of two horizontal periods, and the first emission control pulse overlaps the second emission control pulse by the one horizontal period.

15. The pixel circuit of claim 1, further comprising:

a light-emitting element comprising an anode electrode connected to a fifth node and a cathode electrode to which a low-potential power supply voltage is applied;

a second capacitor connected between the second node and the third node;

a third capacitor connected between the second node and a sixth node;

the first switch element configured to be turned on according to a gate-on voltage of a first scan pulse and to connect the first node to the fourth node in an initialization step and a sensing step;

a second switch element comprising a first electrode to which a second initialization voltage is applied, a second electrode connected to the second node, and a gate electrode to which a second scan pulse is applied, and configured to be turned on according to a gate-on voltage of the second scan pulse and to supply the second initialization voltage to the second node in the initialization step;

a third switch element comprising a first electrode to which a data voltage is applied, a second electrode connected to the sixth node, and a gate electrode to which a fourth scan pulse is applied, and configured to be turned on according to a gate-on voltage of the fourth scan pulse and to supply the data voltage to the sixth node in a data writing step after the sensing step;

a fourth switch element comprising a first electrode to which a first initialization voltage is applied, a second electrode connected to the sixth node, and a gate electrode to which the second scan pulse is applied, and configured to be turned on according to the gate-on voltage of the second scan pulse and to supply the first initialization voltage to the sixth node in the initialization step;

a fifth switch element comprising a first electrode to which the first initialization voltage is applied, a second electrode connected to the fifth node, and a gate electrode to which the second scan pulse is applied, and configured to be turned on according to the gate-on voltage of the second scan pulse and to supply the first initialization voltage to the fifth node in the initialization step;

a sixth switch element comprising a first electrode connected to the third node, a second electrode to which a reference voltage is applied, and a gate electrode to which a third scan pulse is applied, and configured to be turned on according to a gate-on voltage of the third scan pulse and to supply the reference voltage to the third node in the sensing step;

a seventh switch element comprising a first electrode to which a pixel driving voltage is applied, a second electrode connected to the first node, and a gate electrode to which a first emission control pulse is applied, and configured to be turned off in the initialization step, the sensing step, and the data writing step according to a gate-off voltage of the first emission control pulse and to be turned on in a light emission step after the data writing step; and an eighth switch element comprising a first electrode connected to the third node, a second electrode connected to the fifth node, and a gate electrode to which a second emission control pulse is applied, and configured to be turned off in the sensing step and the data writing step according to a gate-off voltage of the second emission control pulse and to be turned on in at least some section of the light emission step, wherein the scan pulse applied to the first switch element is the first scan pulse, the first scan pulse has a pulse width larger than the pulse width of each of the second, third and fourth scan pulses, the second emission control pulse is generated subsequent to the first emission control pulse, and the first and second emission control pulses each have pulse widths larger than that of the first scan pulse, and the pixel driving voltage is higher than the reference voltage and the first and second initialization voltages, and the low-potential power supply voltage is lower than the reference voltage and the first and second initialization voltages.

16. A display device comprising:

a display panel on which a plurality of data lines, a plurality of gate lines, a plurality of power lines, and a plurality of subpixels are disposed;

a data driver configured to convert pixel data into a data voltage and supply the data voltage to the data lines; and a gate driver configured to supply scan pulses to the gate lines, wherein a pixel circuit of the subpixel comprises:

a driving element comprising a first electrode connected to a first node, a gate electrode connected to a second node, and a second electrode connected to a third node;

a switch element comprising a first electrode connected to a fourth node, a gate electrode to which the scan pulse is applied, and a second electrode connected to the first node, and configured to be turned on according to a gate-on voltage of the scan pulse while a threshold voltage of the driving element is sensed; and a first capacitor connected between the second node and the fourth node.

17. The display device of claim 16, further comprising:

a second capacitor connected between the second node and the third node, wherein in a sensing step in which the threshold voltage of the driving element is sensed and an initialization step prior to the sensing step, a voltage of the fourth node is higher than a voltage of the second node.

18. The display device of claim 16, further comprising:

a second capacitor connected between the third node and the fourth node, wherein in a sensing step in which the threshold voltage of the driving element is sensed and an initialization step prior to the sensing step, a voltage of the fourth node is higher than a voltage of the second node.

* * * * *